US006744413B2

(12) United States Patent
Nunomura

(10) Patent No.: US 6,744,413 B2
(45) Date of Patent: Jun. 1, 2004

(54) PLASMA DISPLAY PANEL AND PLASMA DISPLAY APPARATUS HAVING THE SAME

(75) Inventor: Keiji Nunomura, Tokyo (JP)

(73) Assignee: NEC Corporation, Tokyo (JP)

( * ) Notice: Subject to any disclaimer, the term of this patent is extended or adjusted under 35 U.S.C. 154(b) by 351 days.

(21) Appl. No.: 09/739,877

(22) Filed: Dec. 20, 2000

(65) Prior Publication Data

US 2001/0005189 A1 Jun. 28, 2001

(30) Foreign Application Priority Data

Dec. 22, 1999 (JP) ..... 11-365619

(51) Int. Cl.[7] ..... G09G 3/28

(52) U.S. Cl. ..... 345/60; 345/67; 345/63; 345/66; 315/169.4

(58) Field of Search ..... 345/60–72; 313/584, 313/585, 586, 587; 315/169.1, 169.4

(56) References Cited

U.S. PATENT DOCUMENTS

| | | | | | |
|---|---|---|---|---|---|
| 4,554,537 | A | * | 11/1985 | Dick | 345/67 |
| 5,656,893 | A | * | 8/1997 | Shino et al. | 315/169.4 |
| 5,701,056 | A | * | 12/1997 | Shinohara | 313/584 |
| 6,037,916 | A | * | 3/2000 | Amemiya | 345/60 |
| 6,084,349 | A | * | 7/2000 | Ueoka et al. | 313/587 |
| 6,091,380 | A | * | 7/2000 | Hashimoto et al. | 345/60 |
| 6,411,035 | B1 | * | 6/2002 | Marcotte | 313/585 |
| 6,465,956 | B1 | * | 10/2002 | Koshio et al. | 313/586 |

FOREIGN PATENT DOCUMENTS

| | | |
|---|---|---|
| JP | 01-311540 | 12/1989 |
| JP | 05-002993 | 1/1993 |
| JP | 05-121003 | 5/1993 |
| JP | 06-044907 | 2/1994 |
| JP | 07-029497 | 1/1995 |
| JP | 09-244573 | 9/1997 |
| JP | 09-265913 | 10/1997 |
| JP | 10-092326 | 4/1998 |
| JP | 10-133621 | 5/1998 |
| JP | 10-241572 | 9/1998 |
| JP | 10-321144 | 12/1998 |
| JP | 11-095717 | 4/1999 |
| JP | 11-238462 | 8/1999 |
| JP | 2001-006564 | 1/2001 |

* cited by examiner

*Primary Examiner*—Amr Awad
(74) *Attorney, Agent, or Firm*—McGinn & Gibb, PLLC

(57) ABSTRACT

First and second substrates are disposed oppositely to each other in a plasma display panel. A parallel-crossed partition wall, a plurality of bus electrodes, a plurality of display discharge electrodes, and a plurality of data electrodes are provided to the panel. The parallel-crossed partition wall defines a space between the first and second substrates into a plurality of display cells. The bus electrodes are provided in a side of the first substrate opposite the second substrate, and superposed on a portion of the partition wall extended in the line direction when seen from a plane. The display discharge electrodes each are extended from each of the bus electrodes in each of the display cells defined in the columnar direction by a portion of the partition wall overlapping with the bus electrode when seen from the plane. The data electrodes are provided in a side of the second substrate opposite the first substrate and extended in the columnar direction.

31 Claims, 21 Drawing Sheets

PLASMA DISPLAY PANEL AND PLASMA DISPLAY APPARATUS HAVING THE SAME

BACKGROUND OF THE INVENTION

1. Field of the Invention

The present invention relates to a plasma display panel used for a flat television set, an information display or the like, and a plasma display apparatus having the same. More particularly, the invention relates to an AC in-plane discharge plasma display panel capable of providing high-definition and bright displaying, and a plasma display apparatus having the same.

2. Description of the Related Art

The plasma display apparatus is designed to perform displaying by using ultraviolet rays generated by gas discharge to excite a phosphor to emit a light, and expected to be applied to a large-screen television set, an information display or the like. A variety of systems have been developed for a color plasma display apparatus, and an AC in-plane discharge plasma display is advantageous because of its luminance, easy panel manufacturing, and so on. FIG. 1 is a schematic view showing the structure of a typical AC in-plane discharge color plasma display panel of a reflection type. FIG. 2A is a schematic view showing a positional relation among a scanning electrode, a maintenance electrode and a bus electrode in the conventional color plasma display panel. FIG. 2B is a schematic view showing a positional relation between a partition wall and a data electrode in the conventional color plasma display panel.

In a front substrate 100 as a display side substrate, a plurality of strip transparent electrode films 3 and narrow strip bus electrodes 4 are formed in parallel as in-plane discharge electrodes on a glass substrate 1. For the transparent electrode film 3, an ITO thin film or a tin oxide thin film can be used. To supply a sufficient discharge current for the light emission of a large-area panel, however, the electrical resistances of these thin films are too large. Accordingly, the metallic bus electrode 4 having high electrical conductivity is provided. For such a bus electrode 4, an electrode made of, for example, a thick silver film or a metallic thin film containing copper, aluminum, chromium or the like may be used. A dielectric layer 7 is formed over the bus electrodes 4. In general, the dielectric layer 7 is formed in the following manner. That is, first, low melting point glass paste is coated on the transparent electrode film 3 having the bus electrode 4 formed, and by baking this film at a high temperature, a transparent glass layer having a thickness of about 20 to 40 $\mu$m and high withstand voltage is formed. Then, a magnesium oxide thin film having a high secondary electron emission coefficient and a high sputtering resistance is formed as a surface protective layer on the glass layer.

On the other hand, in a backside substrate 200 disposed in parallel with the front substrate 100, a plurality of strip data electrodes 5 and a dielectric layer 10 covering these data electrodes 5 are formed on a glass substrate 2. A main component contained in the dielectric layer 10 is low melting point glass. On the dielectric layer 10, a belt-like partition wall 6 is formed to be extended in a vertical direction (columnar direction). The partition wall 6 is a structure having a width set in a range of about 30 to 120 $\mu$m, and a height set in a range of about 80 to 150 $\mu$m. This structure is generally made of a mixture of oxide powder such as alumina or the like, and low melting point glass. On the bottom portions and the side faces of a plurality of grooves defined by the partition walls 6, phosphor layers 9 each made of powdered phosphor to emit a red, green or blue light are coated. The colors of lights emitted from the phosphor layers 9 are arrayed in a horizontal direction (line direction) in the above order.

Then, the backside substrate 200 and the front substrate 100 are combined together, the peripheries of both substrates are sealed with frit glass and, after the execution of heating and exhaustion, discharge gas containing rare gas as a main component is sealed therein. In this way, the color plasma display panel is constructed.

The partition wall 6 serves to secure discharge space, and prevent crosstalk and the color blotting of an emitted light during discharging.

In the front substrate 100, in-plane discharge electrodes make a pair sandwiching an in-plane discharge gap 11. That is, one is an in-plane discharge electrode (scanning electrode) 13, and the other is an in-plane discharge electrode (maintenance electrode) 14. Then, the conventional color plasma display panel is driven for displaying by applying various voltage waveforms to three kinds of electrodes, i.e., the electrodes 13 and 14, and the data electrode 5 provided in the backside substrate 200.

FIG. 3 is a timing chart showing a driving waveform applied to each electrode when the scanning electrode of the n-th line is designed as Sn, the maintenance electrode is designed as Cn, and the data electrode is designed as Dj.

Scanning pulses are sequentially applied to the scanning electrodes Sn, Sn+1, Sn+2, Sn+3, and so on. In matching with this timing, a data pulse having polarity reverse to that of the scanning pulse is applied to the data electrode Dj according to the display data of a display cell on each of the scanning electrodes. Accordingly, inter-plane discharging occurs between each of the scanning electrodes Sn, . . . and so on, and the data electrode Dj. By a writing operation performed based on such inter-plane discharging, positive wall charges are generated on the surface of each of the scanning electrodes Sn, . . . and so on. In the display cell having the wall charges generated, subsequently, in-plane discharging occurs by a maintenance pulse applied between the maintenance electrodes Cm (Cn, Cn+1, . . . and so on) and each of the scanning electrodes Sn, and so on.

On the other hand, in a display cell having no wall charges generated and no writing performed therein because of the application of no data pulses and the occurrence of no discharging between the data electrode and the scanning electrode, no maintenance discharging occurs even when a maintenance pulse is applied. This is because of the lack of an electric field superposition effect provided by wall charges.

Then, light emission and displaying are carried out by applying the maintenance pulse to the display cell having the wall charges generated by a specified number of times.

For the maintenance electrode Cm, it is not necessary to apply a pulse selected for each piece unlike the case of the scanning pulse. Thus, the respective maintenance electrodes Cm are connected in common and, as shown in FIG. 3, the same voltage waveform is applied thereto. In addition, in a practically used panel, in order to improve the operability of writing, a preparation sequence has been employed for the purpose of Activation inside the display cell and the generation of proper wall charges, which is achieved by applying high voltages to all the display cells prior to a writing operation, and executing a preparation discharging operation for forcible discharging, or the like.

A sub-field method has been employed for the gradational displaying of the AC plasma display. This is due to the fact that in the AC plasma display, the voltage modulation of emitted light displaying luminance is difficult, and the number of light emission times must be changed for luminance modulation. The sub-field method is designed to reproduce a multilevel image by breaking down the multilevel image into a plurality of binary display images and executing continuous displaying at a high speed so as to obtain a visual integration effect.

Such a conventional in-plane discharge AC plasma display has an excellent characteristic. However, as can be understood from the structure of the in-plane discharge electrode shown in FIG. 1, two in-plane discharge electrodes making a pair are necessary for the light emission of one display line. An in-plane discharge gap between such in-plane discharge electrodes is relatively narrow, i.e., in a range of about 50 to 100 $\mu$m. Regarding a non-discharge gap provided between display lines adjacent to each other in the vertical direction, a width larger by three times or more than the in-plane discharge gap is necessary to avoid discharge crosstalk. In addition, for the metallic bus electrode 4, a width of about 100 $\mu$m is necessary because of a material specific resistance and a limitation placed on the manufacturing technology of a large-area panel. Such a limitation causes reductions in the area and the numerical aperture of the in-plane discharge electrode as a pixel pitch is narrowed to increase resolution. Consequently, it is difficult to realize high luminance.

In addition, because of an increase in the number of scanning lines following higher resolution, there is a need to shorten the time of scanning required for the writing of one display line. In the case of a typical television set and the VGA class having 480 lines, full-color displaying by the sub-field method can be performed. However, there has been a big problem inherent in the case of a high-definition television (HDTV) set and a high-resolution display each having the number of scanning lines set equal to about 1000. Specifically, the time of scanning becomes extremely short, making a sure operation difficult and causing writing failures or erroneous lighting. Consequently, good displaying cannot be carried out.

Thus, for the purpose of increasing the area and the numerical aperture of the in-plane discharge electrode, there has been proposed a color plasma display panel, comprising a partition wall extended in a horizontal direction and a bus electrode provided thereon. Hereinafter, this color plasma display will be referred to as a second conventional art, and the foregoing conventional color plasma display panel as a first conventional art. FIG. 4A is a schematic view showing a positional relation among a scanning electrode, a maintenance electrode and a bus electrode in the second conventional art; and FIG. 4B a schematic view showing a positional relation between a partition wall and a data electrode in the second conventional art.

In the second conventional art, as shown in FIG. 4A, an in-plane discharge electrode provided in the front substrate is composed of a wide transparent electrode 15 extended in a horizontal direction, and a bus electrode 16 disposed in the center part of the transparent electrode 15. Also, as shown in FIG. 4B, a partition wall 17 is composed of a horizontal partition wall 17*a* extended in a horizontal direction, and a vertical partition wall 17*b* for further defining a groove defined by the horizontal partition wall 17*a* into a plurality of display cells. Between adjacent display lines, however, the position of the vertical partition wall 17*b* is shifted by half a display cell. In other words, between the display lines adjacent to each other, the display cells are arranged in a triangular pattern. Then, the panel is assembled such that the bus electrode 16 can overlap the horizontal partition wall 17*a* when seen from the plane.

In the second conventional art constructed in the foregoing manner, a so-called double side in-plane discharge electrode structure is employed, where one in-plane discharge electrode is placed over two upper and lower display lines adjacent to each other. Compared with the first conventional art shown in FIG. 2A, there are no light shielding or non-discharge gaps caused by the bus electrode. Accordingly, the effective area and numerical aperture of the in-plane discharge electrode are larger.

In addition, as shown in FIG. 4B, data electrodes 18 are stitched alternately one each among the display cells. Thus, irrespective of the double side in-plane discharge electrode structure, even by driving of a waveform similar to that shown in FIG. 3, each display cell may be independently selected and writing can be carried out.

However, in the case of the triangular arrangement of the display cells, compared with a stripe arrangement like that in the first conventional art, there are problems including slightly worse color mixing, a little lower sharpness of character displaying, and so on. Also, in the second conventional art, if the number of display lines is set equal to, e.g., 480, 480 scanning electrodes and 480+1 maintenance electrodes are necessary. Consequently, it is difficult to realize a high-definition and high-resolution plasma display panel such as HDTV. Further, since the display cells are completely partitioned by the partition walls 17*a* and 17*b* to prevent discharge crosstalk, exhaust conductance is extremely small in the manufacturing process. Thus, it may take a long tine for exhaust processing, or deterioration may occur in a panel characteristic because of residual impurities. Especially, in the large-area and high-definition panel, such a problem tends to be more serious.

Yet another color plasma display panel has been proposed, the structure of which is simplified by adding a change to the driving method (Japanese Patent Laid-open Publication No. Hei 11-65518). Hereinafter, this conventional color plasma display panel will be referred to as a third conventional art. FIG. 5A is a schematic view showing a positional relation among a scanning electrode, a maintenance electrode and a bus electrode in the third conventional art; and FIG. 5B a schematic view showing a positional relation between a partition wall and a data electrode in the third conventional art.

In the third conventional art, the transparent electrode and the bus electrode constituting the maintenance electrodes Cm of the second conventional art are eliminated, and the vertical dimension of a transparent electrode 19 constituting each of scanning electrodes Sn, Sn+1, Sn+2, Sn+3, and so on, is set larger. A partition wall 22 is in a parallel cross shape, and display cells defined by the partition wall 22 are arranged in a stripe pattern.

In the third conventional art constructed in the foregoing manner, if the number of lines is 480, then the necessary number of in-plane discharge electrodes is 480+1. Also, as can be easily understood from FIGS. 5A and 5B, the area of an in-plane discharge electrode directly related to emitted light luminance per unit display area can be set larger than those in the first and second conventional arts. Thus, since the number of in-plane discharge electrodes can be reduced and the area of an in-plane discharge electrode can be increased, the third conventional art is very advantageous especially for the high-resolution and high-definition plasma display panel having a number of scanning lines.

However, though the third conventional art achieves the intended object, the display panel must be operated by a special interlaced driving method, and there is a problem of a small operation margin. In addition, as in the case of the second conventional art shown in FIG. 4B, because of the partitioning of the respective display cells by the partition wall 22, exhaustion takes a long period of time in the manufacturing process, and it is difficult to obtain intra-surface uniformity of a panel characteristic. Consequently, there remains a difficulty of practical use.

SUMMARY OF THE INVENTION

It is an object of the present invention to provide a plasma display panel capable of performing high-resolution and high-definition displaying by obtaining a large area and a large numerical aperture for an in-plane discharge electrode, and securing a large operation margin. It is another object of the invention to provide a plasma display apparatus having such a plasma display panel.

According to one aspect of the present invention, a plasma display panel comprises first and second substrates are disposed oppositely to each other in a plasma display panel. The plasma display panel further comprises a parallel-crossed partition wall, a plurality of bus electrodes, a plurality of display discharge electrodes, and a plurality of data electrodes. The parallel-crossed partition wall defines a space between the first and second substrates into a plurality of display cells. The bus electrodes are provided in a side of the first substrate opposite the second substrate, and superposed on a portion of the partition wall extended in the line direction when seen from a plane. The display discharge electrodes each are extended from each of the bus electrodes in each of the display cells defined in the columnar direction by a portion of the partition wall overlapping with the bus electrode when seen from the plane. The data electrodes are provided in a side of the second substrate opposite the first substrate and extended in the columnar direction.

According to the aspect of the present invention, the bus electrode is superposed on the portion of the partition wall extended in the line direction when seen from the plane, and the display discharge electrode is extended from each of the bus electrodes, when seen from the plane, in each of the display cells defined in the columnar direction by the line-direction extended portion of the partition wall overlapping with the bus electrode. Thus, no discharge interference occurs between the display cells adjacent to each other in the line direction. In addition, the bus electrode is shared by the display cells making a pair, which are defined in the columnar direction by the line-direction extended portion of the partition wall. Thus, even without employing a complex interlaced driving method, high-density and highly accurate displaying can be easily carried out by a three-phase scanning method or the like, which will be described later.

Therefore, it is possible to realize high emitted light luminance and high light emission efficiency. The invention is particularly advantageous for a high-resolution and high-definition panel, and it is possible to manufacture a high performance HDTV set and a high-resolution display at low costs.

According to another aspect of the present invention, a plasma display apparatus comprises the pre-described plasma display panel and a driving device. The driving device applies AC pulses to two display discharge electrodes provided in each of the display cells after execution of writing discharge between the data electrode and the other display discharge electrode in the display cell.

According to another aspect of the present invention, a plasma display apparatus comprises the pre-described plasma display panel and a driving device. The driving device applies a scanning pulse to one of the bus electrodes, first and second voltages different from each other to two of the bus electrodes adjacent to the bus electrode which is applied of the scanning pulse during a scanning period, and then applied AC pulses to two display discharge electrodes provided in each of the display cells.

In these plasma display apparatus, emitted light display is carried out by applying AC pulses to two display discharge electrodes.

According to another aspect of the present invention, a plasma display apparatus for performing interlaced displaying by setting an odd-numbered field and an even-numbered field comprises the pre-described plasma display panel and a driving device. The driving device applies a scanning pulse to odd-numbered ones from the top of the bus electrodes, and maintenance pulses being identical and different in phase for every two adjacent ones of the bus electrodes after applying the scanning pulse to all the odd-numbered bus electrodes, in the case of displaying of the odd-numbered field. The driving device also applies a scanning pulse to even-numbered ones from the top of the bus electrodes, and maintenance pulses being identical and different in phase for every two adjacent ones of the bus electrodes after applying the scanning pulse to all the even-numbered bus electrodes, in the case of displaying of the even-numbered field.

In the plasma display apparatus, emitted light displaying is carried out for a display line of an odd-numbered field, writing having been executed therein, by applying maintenance pulses being identical and different in phase for every two adjacent bus electrodes after applying the scanning pulse, Also, emitted light displaying is carried out for a display line of an even-numbered field, writing having been executed therein, by applying maintenance pulses being identical and different in phase for every two adjacent bus electrodes after applying the scanning pulse. Accordingly, emitted light displaying is carried out on the full surface of the panel.

According to another aspect of the present invention, a plasma display apparatus for performing interlaced displaying by setting an odd-numbered field and an even-numbered field comprises the pre-described plasma display panel and a driving device. The driving device applies a scanning pulse to odd or even-numbered ones from a top of the bus electrodes, and maintenance pulses being identical and different in phase for every two adjacent ones of the bus electrodes after applying the scanning pulse to all the odd or even-numbered bus electrodes, in the case of displaying of the odd-numbered field. The driving device also applies a scanning pulse to even or odd-numbered ones from the top of the bus electrodes, and a data pulse to the data electrode based on display data of a display line shifted by one, and maintenance pulses being identical and different in phase for every two adjacent ones of the bus electrodes after applying the scanning pulse to all the even or odd-numbered bus electrodes, in the case of displaying of the even-numbered field.

In the plasma display apparatus, emitted light displaying is carried out for odd-numbered display lines by applying maintenance pulses being identical and different in phase for every two adjacent bus electrodes after applying the scanning pulse. Also, emitted light displaying is carried out for even-numbered display lines by applying maintenance pulses being identical and different in phase for every two adjacent bus electrodes after applying the scanning pulse. Accordingly, emitted light displaying is carried out on the full surface of the panel.

According to another aspect of the present invention, a plasma display apparatus for performing interlaced displaying by setting an odd-numbered field and an even-numbered field comprises the pre-described plasma display panel and a driving device. The driving device applies a scanning pulse to odd-numbered ones from the top of the bus electrodes, and mutually reversed AC maintenance pulses to two adjacent ones of the bus electrodes after applying the scanning pulse to all the odd-numbered bus electrodes, in the case of displaying of the odd-numbered field. The driving device also applies a scanning pulse to even-numbered ones from the top of the bus electrodes, and mutually reversed AC maintenance pulses to two adjacent ones of the bus electrodes after applying the scanning pulse to all the even-numbered bus electrodes, in the case of displaying of the even-numbered field.

In the plasma display apparatus, emitted light displaying is carried out for two adjacent display lines having a display discharge electrode extended from an odd-numbered bus electrode from a top by applying mutually reversed AC maintenance pulses to two adjacent bus electrodes after applying the scanning pulse. Also, emitted light displaying is carried out for two adjacent display lines having a display discharge electrode extended from an even-numbered bus electrode from the top by applying mutually reversed AC maintenance pulses to two adjacent bus electrodes after applying the scanning pulse. Accordingly, emitted light displaying is carried out on the full surface of the panel.

BRIEF DESCRIPTION OF THE DRAWINGS

FIG. 9A a schematic plan view, and FIG. 9B a sectional view taken along a line A—A of FIG. 9A.

FIG. 10A a schematic plan view, and FIG. 10B a sectional view taken along a line B—B of FIG. 10A.

FIG. 20A a timing chart showing a driving waveform of an odd-numbered field, and FIG. 20B a timing chart showing a driving waveform of an even-numbered field.

FIG. 21A a timing chart showing a driving waveform of an odd-numbered field, and FIG. 21B a timing chart showing a driving waveform of an even-numbered field.

FIG. 22A a timing chart showing a driving waveform of an odd-numbered field, and FIG. 22B a timing chart showing a driving waveform of an even-numbered field.

DETAILED DESCRIPTION OF THE PREFERRED EMBODIMENT

Hereinafter, the preferred embodiments of the present invention will be described in detail with reference to the accompanying drawings. First, description will be made of the structure of a plasma display panel of an embodiment, and then of the driving method of the embodiment of a display apparatus related to an embodiment incorporating such a panel. In the description, vertical and horizontal directions mean vertical and horizontal directions in the case where the plasma display apparatus is hung on a wall or the like to be used. These directions are equivalent to columnar and line directions within the scope or the like of appended claims. Simple upper and lower directions indicate upper and lower directions in the thickness direction of a glass substrate or the like. In addition, as a reference for the upper and lower directions, the direction of stacking a laminate on the glass substrate is set as an upper direction in a manufacturing process.

Figure 1:
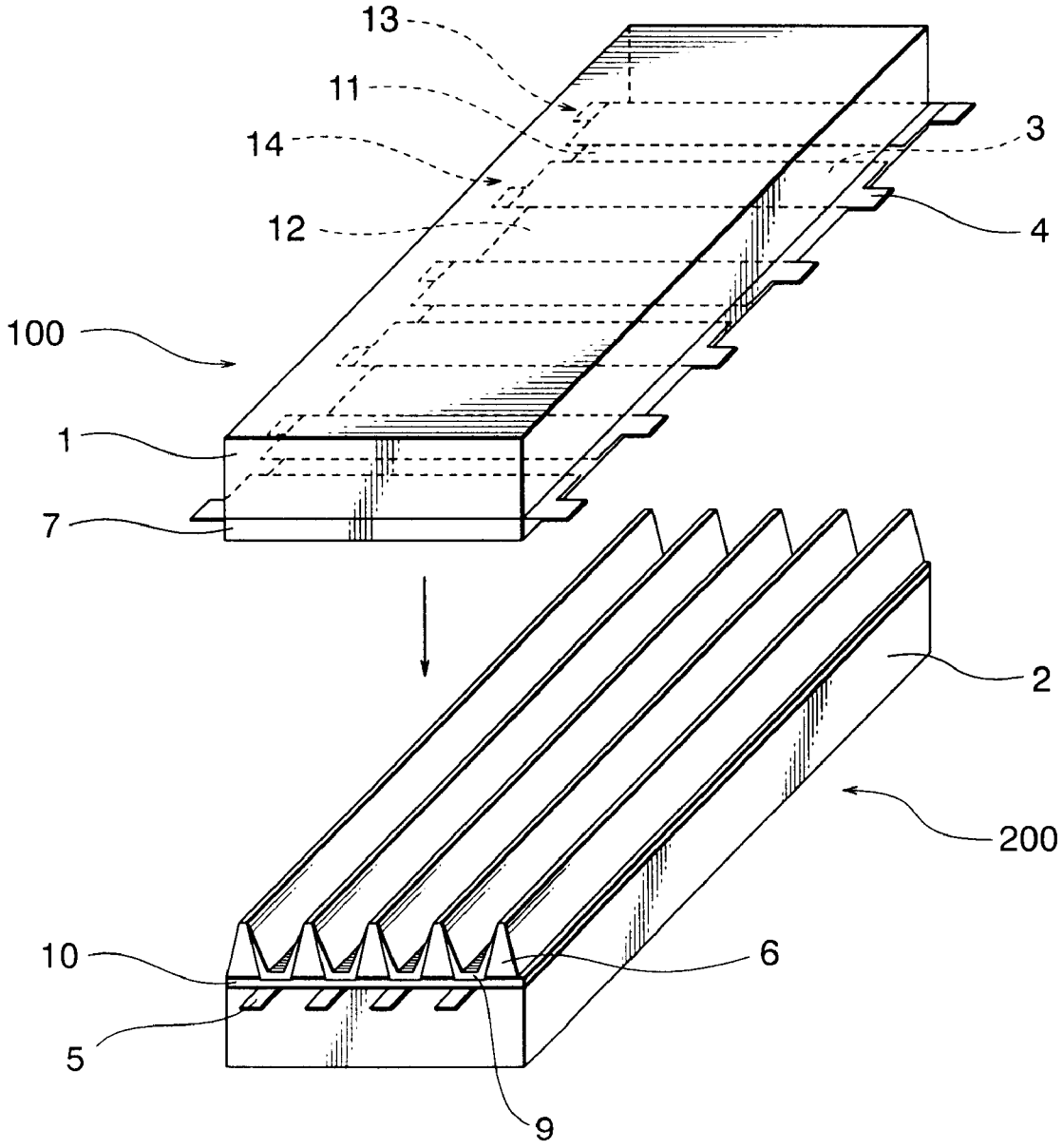
FIG. 1 (PRIOR ART)
FIG. 1 is a schematic view showing a structure of a typical AC in-plane discharge color plasma display panel of a reflection type.
Figure 2A:
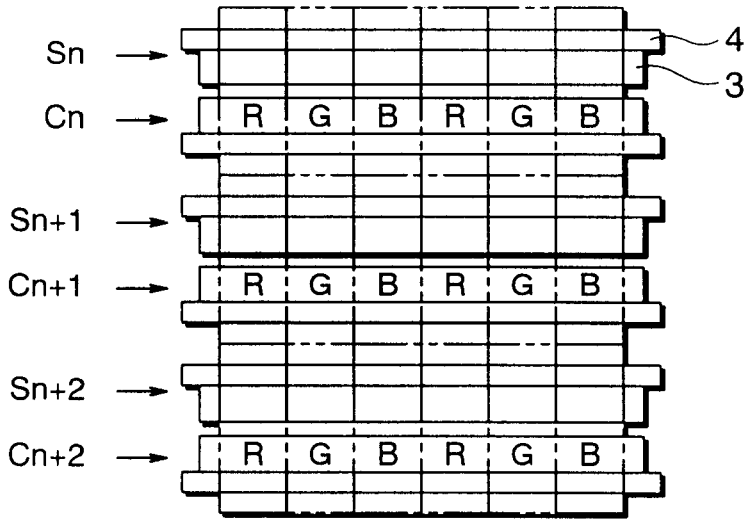
FIG. 2A (PRIOR ART)
FIG. 2A is a schematic view showing a positional relation among a scanning electrode, a maintenance electrode and a bus electrode in a first conventional art.
Figure 2B:
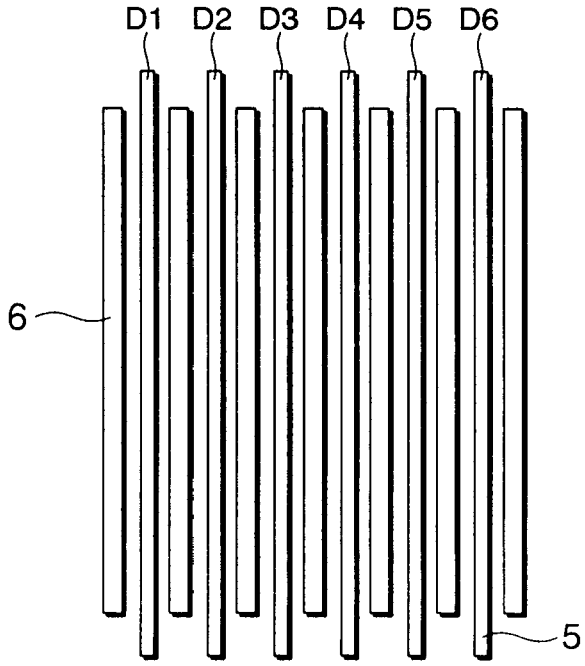
FIG. 2B (PRIOR ART)
FIG. 2B is a schematic view showing a positional relation between a partition wall and a data electrode in the first conventional art.
Figure 3:
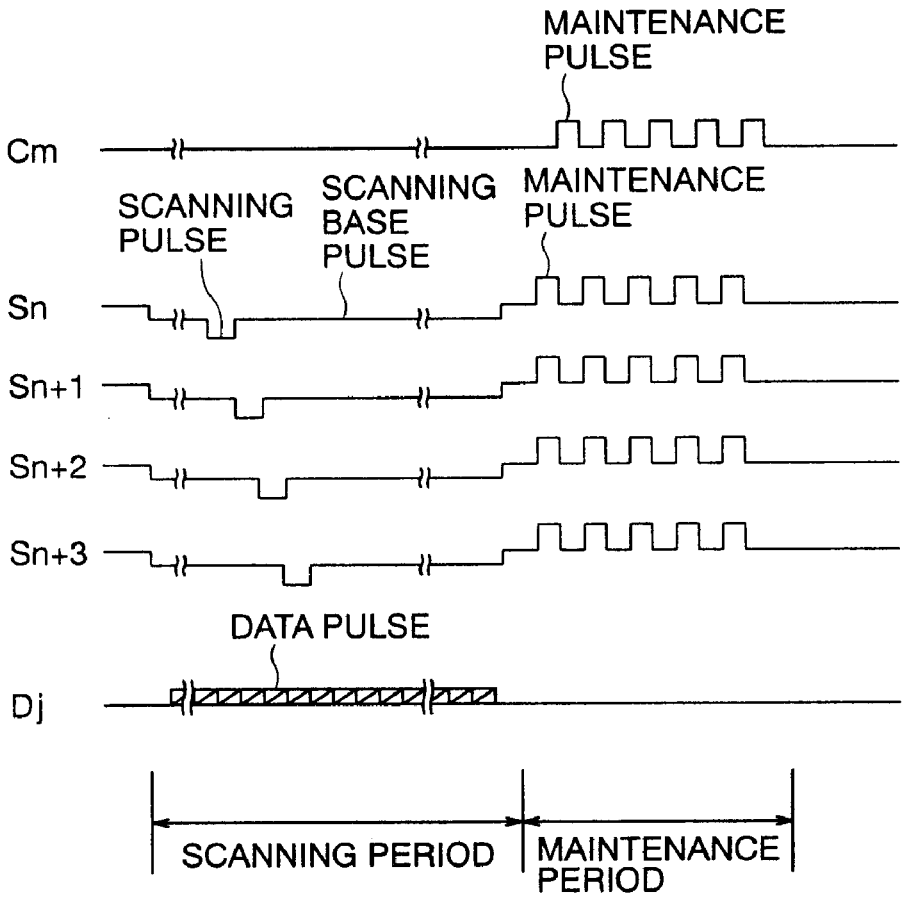
FIG. 3 PRIOR ART
FIG. 3 is a timing chart showing a driving waveform applied to each electrode when a scanning electrode of the n-th line is designated as Sn.
Figure 4A:
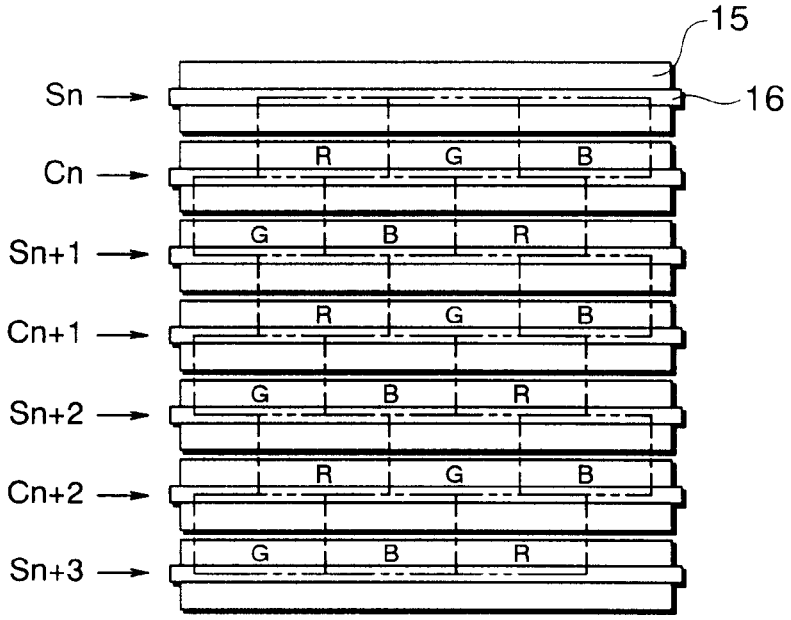
FIG. 4A (PRIOR ART)
FIG. 4A is a schematic view showing a positional relation among a scanning electrode, a maintenance electrode and a bus electrode in a second conventional example.
Figure 4B:
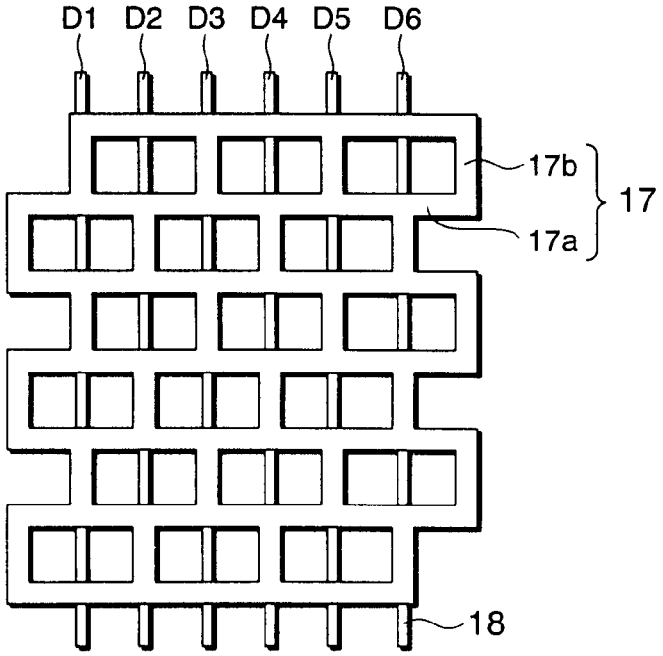
FIG. 4B (PRIOR ART)
FIG. 4B is a schematic view showing a positional relation between a partition wall and a data electrode in the second conventional example.
Figure 5A:
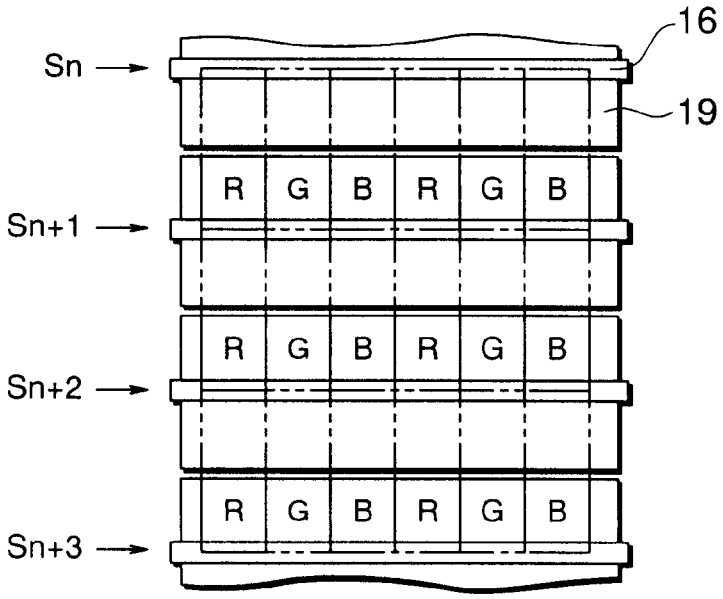
FIG. 5A (PRIOR ART)
FIG. 5A is a schematic view showing a positional relation among a scanning electrode, a maintenance electrode and a bus electrode in a third conventional example.
Figure 5B:
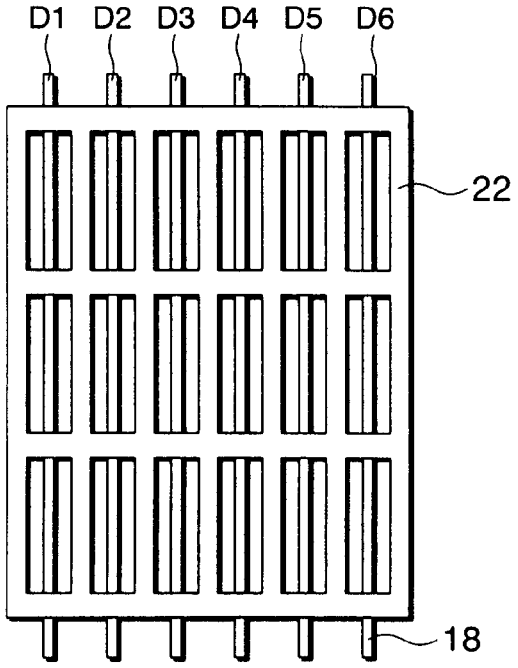
FIG. 5B (PRIOR ART)
FIG. 5B is a schematic view showing a positional relation between a partition wall and a data electrode in the third conventional example.
Figure 6:
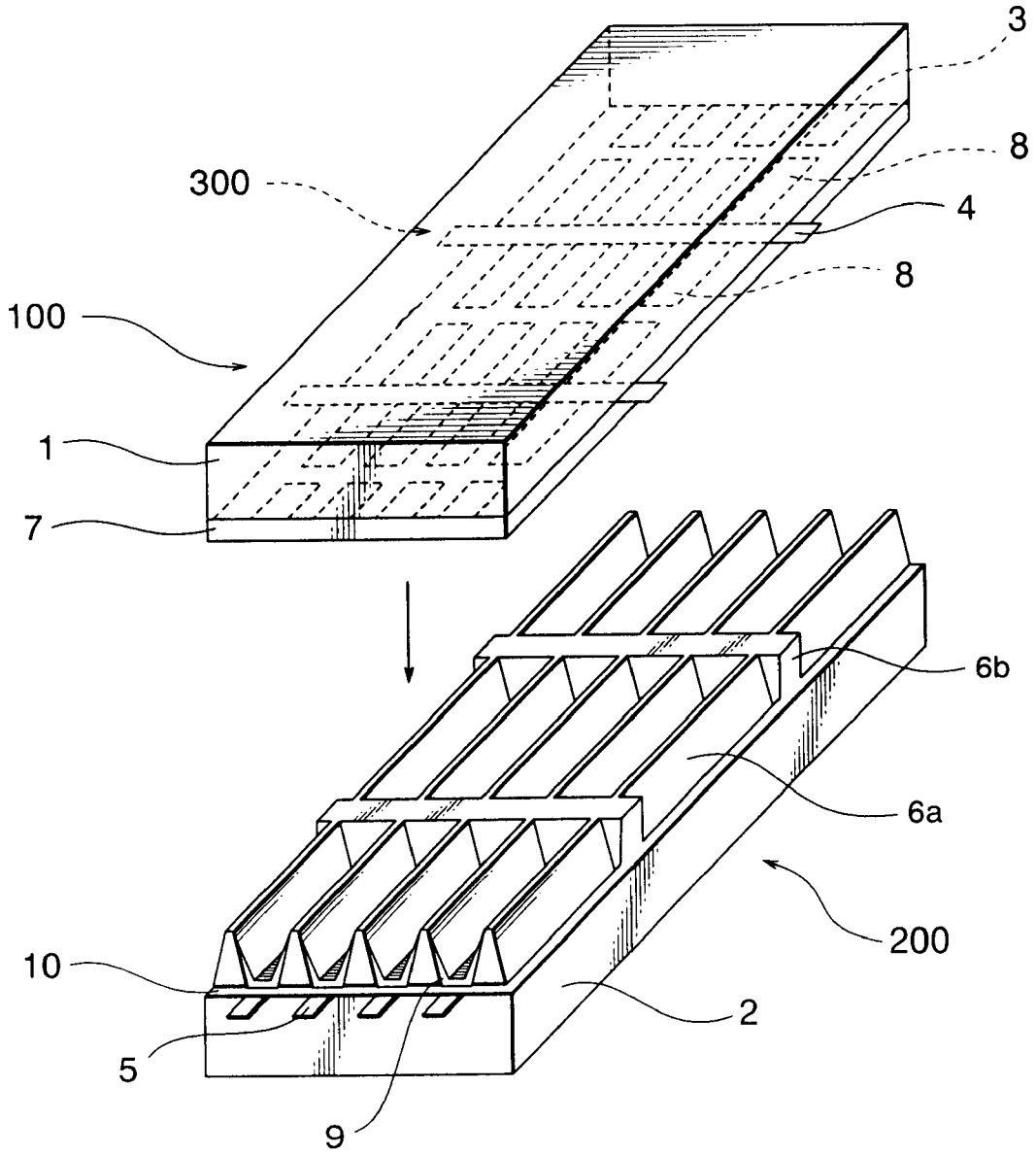
FIG. 6 is a schematic view showing a structure of a plasma display panel according to a first embodiment of the present invention.

FIG. 6 is a schematic view showing the structure of a plasma display panel according to a first embodiment of the invention.

A plurality of rectangular transparent electrode films 3 are disposed in a matrix pattern on a glass substrate 1. Each of the transparent electrode films 3 may be formed by patterning, for example an ITO transparent conductive thin film in the form of a thin and long strip. Each of the pixel pitches of the horizontal and vertical directions in the embodiment may be set equal to, e.g., 0.81 mm. The rectangular transparent electrode film 3 has vertical and horizontal dimensions of, e.g., 0.74 mm and 0.19 mm respectively, and vertical and horizontal pitches of, e.g., 0.81 mm and 0.27 mm respectively. However, the invention is not limited to these dimensions.

In addition, a plurality of bus electrodes 4 are provided so as to be horizontally extended continuously through the center parts of the plurality of transparent electrode films 3 constituting a line. Portions of the transparent electrode film 3 bulged out of both sides of the bus electrode 4 are display discharge electrodes 8. In this manner, a double side in-plane discharge electrode 300 having a structure having the display discharge electrodes 8 extended from both sides of the bus electrode 4 may be constructed. Power is supplied through the bus electrode 4 to each of the display discharge electrode 8 from an external unit. The bus electrode 4 is made of, e.g., a photosensitive silver thick film, having a width set equal to, e.g., 0.1 mm. To enhance display contrast, the bus electrode 4 has a laminated structure of two black and white layers, e.g., a black layer provided in a display side and a low-resistant white layer formed thereon.

Further, on the glass substrate 1, a transparent dielectric layer 7 made of a glazed layer and an MgO surface protective layer is provided to cover the double side in-plane discharge electrode 300 composed of the transparent electrode film 3 and the bus electrode 4. In this manner, a front substrate 100 may be constructed.

On the other hand, in a backside substrate 200 disposed in parallel with the front substrate 100, a plurality of data electrodes 5 vertically extended are formed on a glass substrate 2. Each of the data electrodes 5 can be formed by, for example, using sputtering to form an aluminum thin film on the glass substrate 2, and then patterning this thin film by etching. The data electrode 5 has a width of, e.g., 0.09 mm, and a pitch of, e.g., 0.27 mm.

Also, on the glass substrate 2, a dielectric layer 10 is formed to cover the data electrodes 5. On the dielectric layer 10, a parallel-crossed partition wall including a vertical partition wall 6*a* vertically extended and a horizontal partition wall 6*b* horizontally extended is formed. The dielectric layer 10 may contain low melting point glass as a main component. The vertical and horizontal partition walls 6*a* and 6*b* are formed by, e.g., a sandblasting method. The upper width of the vertical partition wall 6*a* is set equal to, e.g., about 40 $\mu$m; and the upper width of the horizontal partition wall 6*b* equal to, e.g., about 100 $\mu$m. However, the present invention is not limited to these widths.

Further, a phosphor layer 9 made of powdered phosphor to emit a red, green or blue light is coated on the bottom and side faces of each of a plurality of recesses defined by the partition walls 6*a* and 6*b*. The emitted light colors of the phosphor layers 9 may be arrayed in a horizontal direction in the above order. In this way, the backside substrate 200 may be constructed.

Then, the backside and front substrates 200 and 100 are combined together. The peripheries of both substrates are sealed with frit glass, and discharge gas containing rare gas as a main component is sealed in after heating and exhaustion. In this way, a color plasma display panel may be constructed. As shown in FIG. 6, the backside and front substrates 200 and 100 are assembled after vertical and horizontal aligning such that when seen from a plane, the bus electrode 4 can be superposed on the horizontal partition wall 6*b*, and the a gap between the display discharge electrodes 8 adjacent to each other in the horizontal direction can be superposed on the vertical partition wall 6*a*.

According to the first embodiment constructed in the foregoing manner, since the bus electrode 4 for supplying power to each of the display discharge electrodes 8 is superposed on the horizontal partition wall 6*b* when seen from the plane and the display discharge electrodes 8 are separated from each other between display cells adjacent to each other in the horizontal direction, a large driving margin can be secured by a later-described simple driving method. Moreover, since a numerical aperture can be set high and the area of each of the display discharge electrodes 8 can be set large, high luminance can be obtained.

Figure 7A:
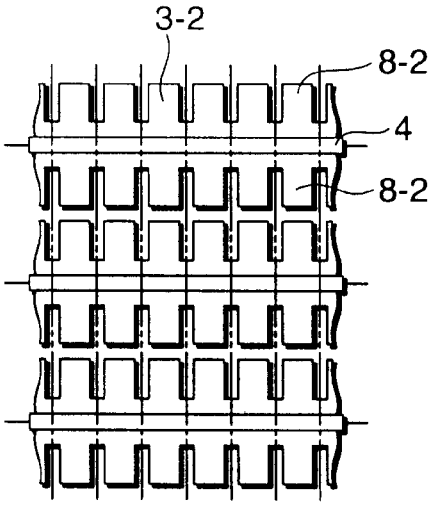
FIG. 7A is a schematic plan view showing a display discharge electrode according to a second embodiment.
Figure 7B:
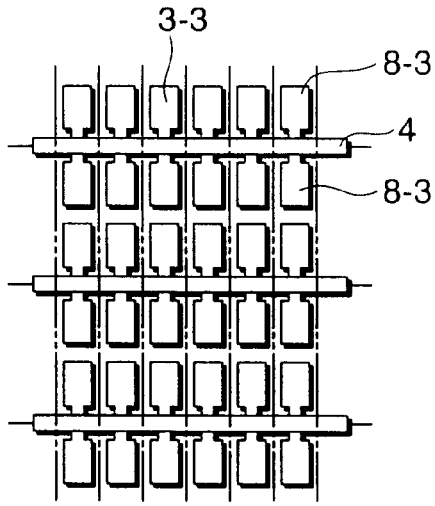
FIG. 7B is a schematic plan view showing a display discharge electrode according to a third embodiment.
Figure 7C:
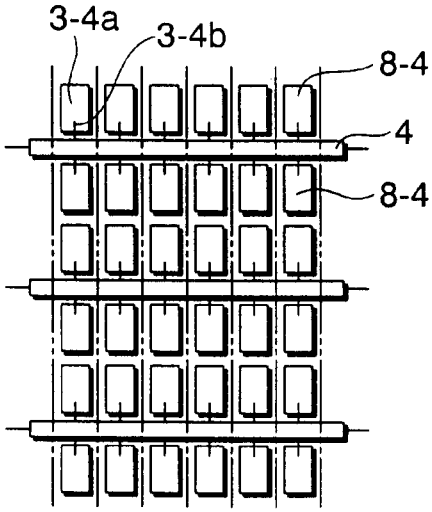
FIG. 7C is a schematic plan view showing a display discharge electrode according to a fourth embodiment.

As long as the display discharge electrodes are effectively separated from each other between the display cells adjacent to each other in the horizontal direction, a shape thereof is not limited to a particular rectangular shape. Next, description will be made of second to fifth embodiments having display discharge electrodes, which are modifications of those of the first embodiment. FIG. 7A is a schematic plan view showing a display discharge electrode according to the second embodiment; FIG. 7B a schematic plan view showing a display discharge electrode according to the third embodiment; FIG. 7C a schematic plan view showing a display discharge electrode according to the fourth embodiment; and FIG. 7D a schematic plan view showing a display discharge electrode according to the fifth embodiment.

In the second embodiment, as shown in FIG. 7A, a transparent electrode film 3-2 having a comb-teeth shape is provided. A portion protruded from the axial part of each of the comb teeth may function as a display discharge electrode 8-2. Then, the bus electrode 4 is aligned with the axial part of the comb teeth.

According to the second embodiment thus constructed, compared with the first embodiment, since a contact area is large between the bus electrode 4 and the transparent electrode film 3-2 constituting the display discharge electrode 8-2, electric connection is improved therebetween. Thus, the embodiment is advantageous for preventing dark spots.

In the third embodiment, as shown in FIG. 7B, a transparent electrode film 3-3 is formed such that a width between both ends thereof can be larger than that of a center part. In other words, a display discharge electrode 8-3 is provided, which is formed such that the width of a tip portion can be larger than that of a connection portion with the bus electrode 4.

In a panel manufacturing process, relative positional shifting may occur between the transparent electrode and the bus electrode, or the horizontal partition wall may be shifted from the center part of the bus electrode or the transparent electrode. However, in a simple rectangular electrode like that of the first embodiment shown in FIG. 6, the area of the display discharge electrode may become nonuniform in the upper and lower sides of the bus electrode according to the shifting. As in-plane discharge strength is affected by the electrode having a smaller area, luminance is reduced with the size of shifting. On the other hand, if the width of the display discharge electrode 8-3 is smaller in the vicinity of the connection portion with the bus electrode 4 like that of the third embodiment shown in FIG. 7B, a change in the electrode area is limited even when shifting occurs. For example, if the width of the display discharge electrode 8-3 in the vicinity of the bus electrode 4 is ⅓ of the wide portion of the tip thereof, then the amount of change in luminance is reduced to ⅓ with respect to the same shifting, making it possible to increase a margin for shifting. Moreover, since the spread of discharge to a region near the bus electrode 4 and the horizontal partition wall 6*b* is limited, the embodiment is advantageous for increasing light emission efficiency.

In the fourth embodiment, as shown in FIG. 7C, a display discharge electrode 8-4 is composed of a metal pattern 3-4*b* connected to the bus electrode 41 being small in width and high in conductivity, and a rectangular transparent electrode film 3-4*a* connected to the metal pattern 3-4*b*. The metal pattern 3-4*b* may be patterned simultaneously with, for example, the patterning of the bus electrode 4.

According to the fourth embodiment thus constructed, as in the case of the third embodiment, a shifting margin can be increased, realizing the enhancement of light emission efficiency.

Figure 7D:
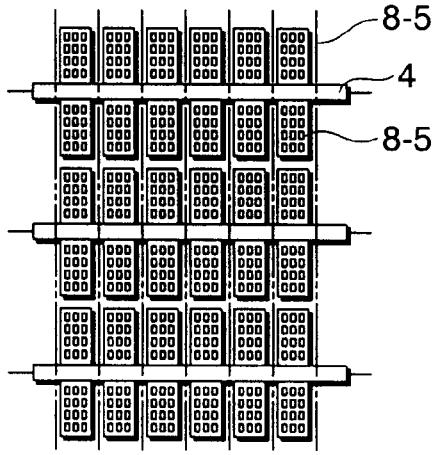
FIG. 7D is a schematic plan view showing a display discharge electrode according to a fifth embodiment.

In the fifth embodiment, as shown in FIG. 7D, a display discharge electrode 8-5 is formed by being patterned in a meshed shape.

According to the fifth embodiment thus constructed, since there is no need to use transparent electrodes for the display discharge electrode 8-5, a manufacturing process can be simplified. In other words, it is only necessary to pattern a metallic thin film simultaneously with the patterning of the bus electrode 4.

The display discharge electrode may take a shape more complex than those of the first to fifth embodiments shown in FIG. 6 and FIGS. 7A to 7D.

Figure 8A:
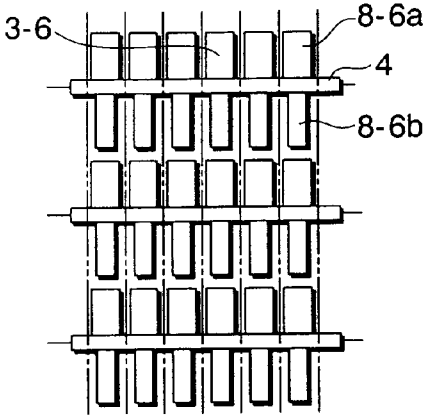
FIG. 8A is a schematic plan view showing a display discharge electrode according to a sixth embodiment.
Figure 8B:
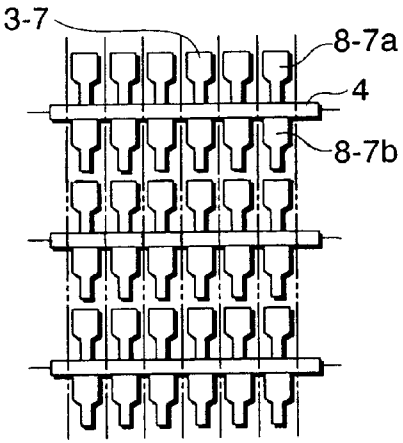
FIG. 8B is a schematic plan view showing a display discharge electrode according to a seventh embodiment.
Figure 8C:
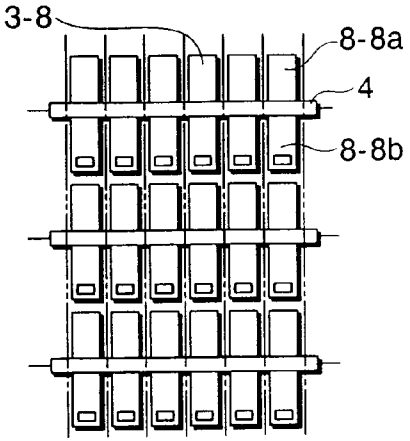
FIG. 8C is a schematic plan view showing a display discharge electrode according to an eighth embodiment.
Figure 8D:
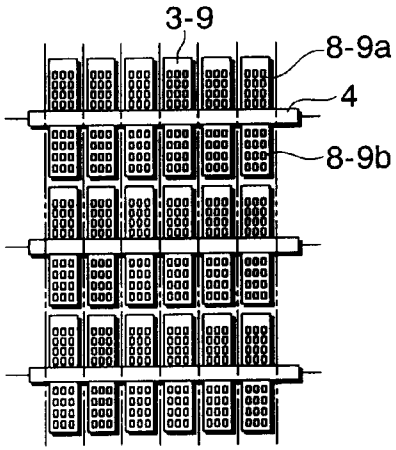
FIG. 8D is a schematic plan view showing a display discharge electrode according to a ninth embodiment.

Next, sixth to tenth embodiments of the invention will be described. In each of the sixth to tenth embodiments, the display discharge electrode connected to the bus electrode has different shapes in the vertical upper and lower sides of the bus electrode. Hereinafter, the plasma display panel specified in each of the first to fifth embodiments will be referred to as a symmetrical panel; the plasma display panel specified in each of the sixth to tenth embodiments as an asymmetrical panel. FIG. 8A is a schematic plan view showing a display discharge electrode according to the sixth embodiment; FIG. 8B a schematic plan view showing a display discharge electrode according to the seventh embodiment; FIG. 8C a schematic plan view showing a display discharge electrode according to the eighth embodiment; FIG. 8D a schematic plan view showing a display discharge electrode according to the ninth embodiment; and FIG. 8E a schematic plan view showing a display discharge electrode according to the tenth embodiment.

In the sixth embodiment, as shown in FIG. 8A, a transparent electrode film 3-6 having a width changed in two stages in the vertical direction of the panel is provided. Specifically, the upper half width of each transparent electrode film 3-6 is larger than a lower half width. Then, as in the case of the first embodiment, the bus electrode 4 is connected to the center parts of a plurality of transparent electrode films 3-6 constituting a line. A display discharge electrode 8-6*a* extended from the bus electrode 4 in its vertical upper side and a display discharge electrode 8-6*b* extended in its vertical lower side are formed of such transparent electrode films 3-6. The width of the display discharge electrode 8-6*a* is larger than that of the display discharge electrode 8-6*b*.

According to the sixth embodiment thus constructed, with respect to one display cell, the width of the display discharge electrode 8-6*b* located in the vertical upper side becomes smaller than that of the display discharge electrode 8-6*a* located in the vertical lower side. Accordingly, the display discharge electrode 8-6*a* has a lower inter-plane discharge starting voltage, making it easier for inter-plane discharging to occur with the data electrode provided in the backside substrate than the display discharge electrode 8-6*b*. Thus, by applying a pulse equivalent to the intermediate voltage of the inter-plane discharge starting voltages of the two display discharge electrodes 8-6*a* and 8-6*b* provided in one display cell, inter-plane discharging can be generated only between the display discharge electrode 8-6*a* located in the vertical lower side and the data electrode. As a result, it is possible to secure a large driving margin by a later-described simple driving method.

In the seventh embodiment, as shown in FIG. 8B, a transparent electrode film 3-7 having a width changed in four stages in the vertical direction of the panel is provided. Specifically, each transparent electrode film 3-7 is divided into two portions at the center part of the vertical direction, and each of these is further divided into two portions. The width of the uppermost portion is larger than that of the second portion from the upper edge, and the width of lowermost portion is smaller than that of the second portion from the lower edge. To make comparison between the uppermost and lowermost portions, the width of the uppermost portion is larger than that of the lowermost portion. Then, as in the case of the first embodiment, the bus electrode 4 is connected to the center parts of a plurality of transparent electrode films 3-7 constituting a line. A display discharge electrode 8-7*a* extended from the bus electrode 4 in its vertical upper side and a display discharge electrode 8-7*b* extended in its vertical lower side are formed of such transparent electrode films 3-7. The width of the end of the display discharge electrode 8-7*a* is larger than that of the end of the display discharge electrode 8-7*b*.

According to the seventh embodiment thus constructed, with respect to one display cell, the width of the end of the display discharge electrode 8-7*b* located in the vertical upper side becomes smaller than that of the end of the display discharge electrode 8-7*a* located in the vertical lower side. Accordingly, the display discharge electrode 8-7*a* has a lower inter-plane discharge starting voltage, making it easier for inter-plane discharging to occur with the data electrode provided in the backside substrate than the display discharge electrode 8-7*b*. As a result, as in the case of the sixth embodiment, it is possible to secure a large driving margin by a later-described simple driving method.

In the eighth embodiment, as shown in FIG. 8C, a transparent electrode film 3-8 having an opening formed in its lower end is provided. Then, as in the case of the first embodiment, the bus electrode 4 is connected to the center parts of a plurality of transparent electrode films 3-8 constituting a line. A display discharge electrode 8-8*a* extended from the bus electrode 4 in its vertical upper side and a display discharge electrode 8-8*b* extended in the vertical lower side and having an opening provided in its end are formed of such transparent electrode films 3-8.

According to the eighth embodiment thus constructed, with respect to one display cell, the sectional area of the tip of the display discharge electrode 8-8*b* located in the vertical upper side becomes smaller than that of the tip of the display discharge electrode 8-8*a* located in the vertical lower side by an amount equivalent to the opening. Thus, the display discharge electrode 8-8*a* has a lower inter-plane discharge starting voltage, making it easier for inter-plane discharging to occur with the data electrode provided in the backside substrate than the display discharge electrode 8-8*b*. As a result, as in the case of the sixth embodiment, it is possible to secure a large driving margin by a later-described simple driving method.

In the ninth embodiment, as shown in FIG. 8D, a netlike metal film 3-9 is provided, which includes a portion made of a meshed metallic thin film and a portion provided in the upper end thereof and made of an unmeshed metallic thin film. Then, as in the case of the first embodiment, the bus electrode 4 is connected to the center parts of a plurality of netlike metal films 3-9 constituting a line. A display discharge electrode 8-9*a* extended from the bus electrode 4 in its vertical upper side and with an unmeshed portion in its end and a display discharge electrode 8-9*b* extended in the vertical lower side are formed of such netlike metal films 3-9.

According to the ninth embodiment thus constructed, with respect to one display cell, the sectional area of the tip of the display discharge electrode 8-9*b* located in the vertical upper side becomes smaller than that of the unmeshed portion of the tip of the display discharge electrode 8-9*a* located in the vertical lower side by an amount equivalent to the meshed portion. Accordingly, the display discharge electrode 8-9*a* has a lower inter-plane discharge starting voltage, making it easier for inter-plane discharging to occur with the data electrode provided in the backside substrate than the display discharge electrode 8-9*b*. As a result, as in the case of the sixth embodiment, it is possible to secure a large driving margin by a later-described simple driving method.

Figure 8E:
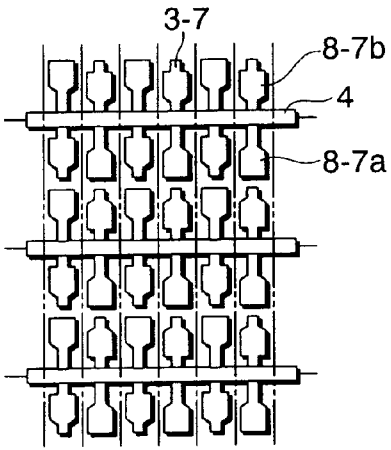
FIG. 8E is a schematic plan view showing a display discharge electrode according to a tenth embodiment.

In the tenth embodiment, as shown in FIG. 8E, the upper and lower directions of the display discharge electrode 8-7 of the seventh embodiment are reversed for each column. Also in this case, an advantage similar to that of the seventh embodiment can be obtained. However, a driving method for the tenth embodiment is different from that for the seventh embodiment.

With respect to one display cell, as long as the two display discharge electrodes have different shapes, and different inter-plane discharge characteristics, each of the display discharge electrodes may take a shape more complex than those of the sixth to tenth embodiments shown in FIGS. 8A to 8E.

In addition, the display discharge electrodes may have different lengths.

Figures 9A, 9B:
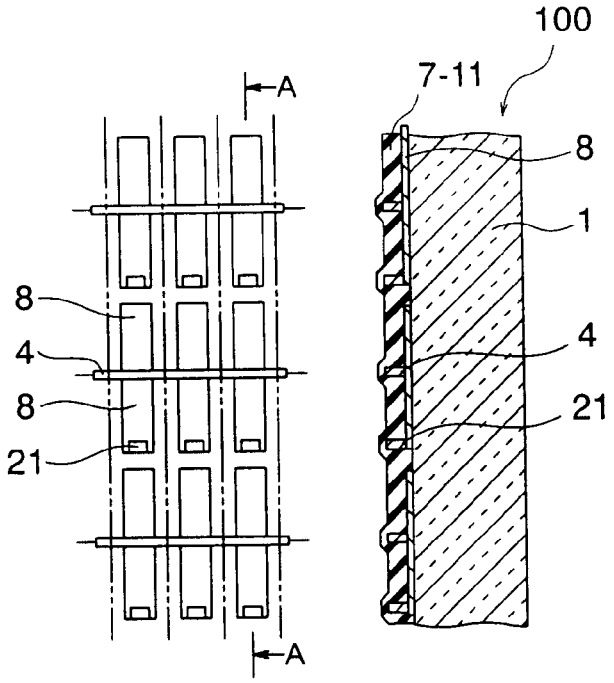
FIGS. 9A and 9B are views each showing a plasma display panel according to an eleventh embodiment of the invention.
Figures 10A, 10B:
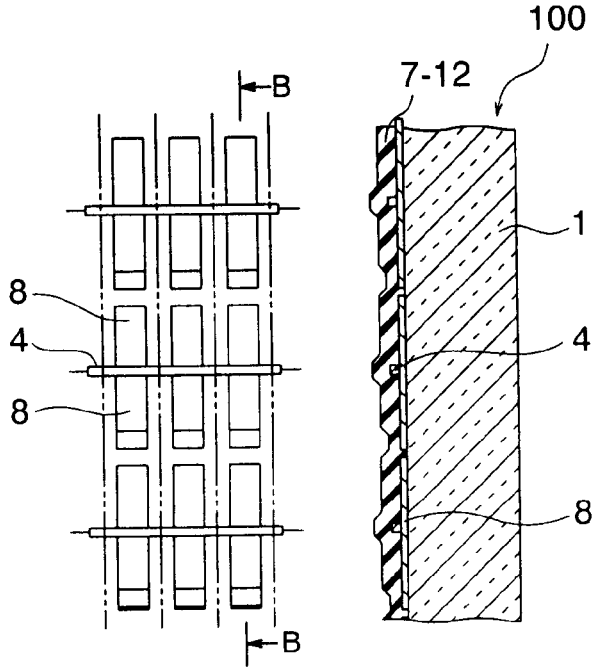
FIGS. 10A and 10B are views each showing a plasma display panel according to a twelfth embodiment of the invention.

Next, eleventh and twelfth embodiments of the invention will be described. In the sixth to tenth embodiments, the two display discharge electrodes are formed in different shapes with respect to one display cell, and thereby inter-plane discharge characteristics are set different therebetween. In the eleventh and twelfth embodiments, a dielectric film in the front substrate side has shapes different on the two display discharge electrodes. Each of FIGS. 9A and 9B illustrates a plasma display panel according to the eleventh embodiment of the invention: FIG. 9A a schematic plan view, and FIG. 9B a sectional view taken along a line A—A of FIG. 9A. Each of FIGS. 10A and 10B illustrates a plasma display panel according to the twelfth embodiment: FIG. 10A a schematic plan view, and FIG. 10B a sectional view taken along a line B—B of FIG. 10A. In FIGS. 9A and 9B, and FIGS. 10A and 10B, however, because some components are omitted to explicitly illustrate desired components, components shown in one may be omitted in the other.

In the eleventh embodiment, as shown in FIGS. 9A and 9B, a metallic dot 21 protruded in a thickness direction is provided on the vertical lower side end of the transparent electrode film 3 made of a transparent conductive film such as an ITO thin film or the like. This dot 21 can be easily formed by patterning photosensitive silver paste simultaneously when the bus electrode 4 is formed by using the photosensitive silver paste. The dot 21 has a thickness set equal to, e.g., about 8 $\mu$m. A dielectric layer 7-11 is formed on the glass substrate 1 to cover the display discharge electrodes 8. In a position having the dot 21 formed therein, the dielectric layer 7-11 is swollen a little more than the other portions. The dielectric layer 7-11 of this portion has a thickness thinner by, e.g., about 5 $\mu$m than that of a portion aligned with a region having no dots 21 of the transparent electrode film 3 formed therein.

According to the eleventh embodiment thus constructed, with respect to one display cell, a dot 21 is provided in the tip of a display discharge electrode 8-11*b* located in the vertical upper side, while no dots are provided in a display discharge electrode 8-11*a* located in the vertical lower side, and the thickness of the dielectric layer 7-11 aligned with the dot portion is thinner than those of the other portions. Thus, the display discharge electrode 8-11*b* has a lower inter-plane discharge starting voltage than the display discharge electrode 8-11*a*.

An electrically conductive projection portion like the dot 21 provided on the display discharge electrode is more advantageous for lowering an inter-plane discharge starting voltage as it is wider. However, an excessively large projection portion is not advisable, because it cuts off a light emitted from the phosphor layer. To obtain the advantage of lowering a discharge starting voltage by a smaller projection, the projection should preferably be provided in a position near an in-plane discharge gap.

In the twelfth embodiment, as shown in FIGS. 10A and 10B, a dielectric layer 7-12 is provided on the glass substrate 1 to cover the display discharge electrodes 8. The thickness of the portion of the dielectric layer 7-12 aligned with the vertical lower end of the display discharge electrode 8 is thinner than those of the other portions. For example, the thickness of that portion is about 20 $\mu$m, while the thickness of the other portions is about 30 μm. The dielectric layer 7-12 of such a shape can be formed by, e.g., pattern printing of a glazed layer, use of photosensitive glazing paste or a method such as pattern etching of the glazed layer.

According to the twelfth embodiment thus constructed, with respect to one display cell, the thickness of the portion of the dielectric layer 7-12 covering the display discharge electrode 8 located in the vertical upper side is thinner than that of the portion covering the display discharge electrode 8 located in the vertical lower side, and generally an inter-plane discharge starting voltage with the data electrode becomes lower as the thickness of the dielectric layer is thinner. Accordingly, the display discharge electrode 8 located in the vertical upper side has a lower inter-plane discharge starting voltage.

With respect to one display cell, the entire portion of the dielectric layer covering one display discharge electrode may be formed thin. However, to set inter-plane discharge characteristics different between the two display discharge electrodes, only one portion of the dielectric layer may be made thin. In addition, in the twelfth embodiment shown in FIGS. 10A and 10B, the thin portion of the dielectric layer 7-12 is formed in a dot shape. But this thin film portion may be formed like a belt extended in a horizontal direction. In such a case, it may be more advantageous if the dielectric layer is made thin especially in a portion near an in-plane discharge gap.

Further, instead of providing a characteristic to the shape of the dielectric layer like that in each of the eleventh and twelfth embodiments, by providing a feature to the characteristic of the dielectric layer, inter-plane discharge characteristics can be set different between the two display discharge electrodes provided in one display cell. For example, a difference may be set between a secondary electron emission coefficient on the surface of the dielectric layer on one display discharge electrode and that on the other display discharge electrode. Specifically, a structure may be employed, where a magnesium oxide film is formed on one, while no magnesium oxide film is formed, or an alumina film or the like having a small secondary electron emission coefficient is formed on the other.

Figure 11A:
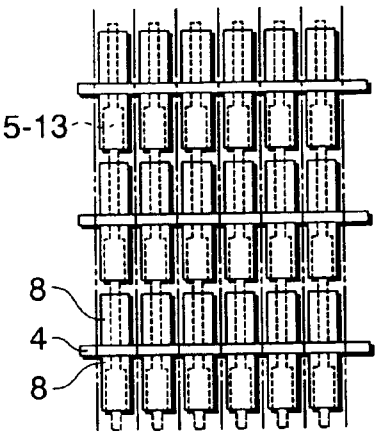
FIG. 11A is a schematic plan view showing a data electrode according to a thirteenth embodiment.
Figure 11B:
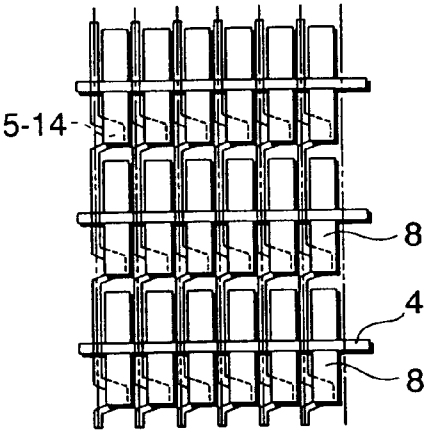
FIG. 11B is a schematic plan view showing a data electrode according to a fourteenth embodiment.
Figure 11C:
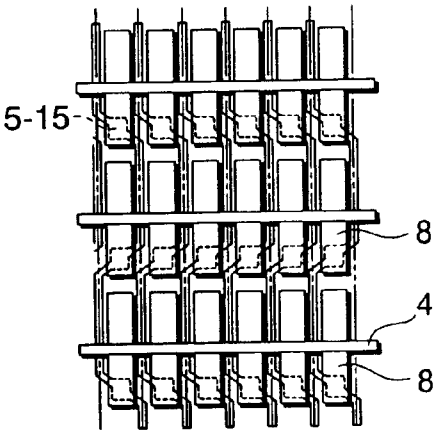
FIG. 11C is a schematic plan view showing a data electrode according to a fifteenth embodiment.
Figure 11D:
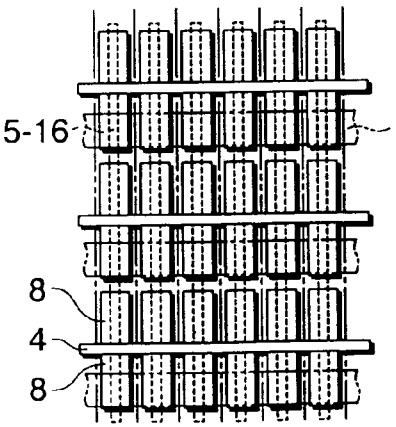
FIG. 11D is a schematic plan view showing a data electrode according to a sixteenth embodiment.

Next, thirteenth to nineteenth embodiments of the invention will be described. In each of the thirteenth to seventeenth embodiments, the data electrode has different shapes in regions respectively aligned with the two display discharge electrodes in one display cell. FIG. 11A is a schematic plan view showing a data electrode according to the thirteenth embodiment; FIG. 11B a schematic plan view showing a data electrode according to the fourteenth embodiment; FIG. 11C a schematic plan view showing a data electrode according to the fifteenth embodiment; FIG. 11D a schematic plan view showing a data electrode according to the sixteenth embodiment; and FIG. 11E a schematic plan view showing a date electrode according to the nineteenth embodiment. FIG. 12A is a sectional view showing the structure of the sixteenth embodiment; FIG. 12B a sectional view showing the structure of the seventeenth embodiment; and FIG. 12C a sectional view showing the structure of the eighteenth embodiment.

In the thirteenth embodiment, as shown in FIG. 11A, a data electrode 5-13 extended in the vertical direction is provided. The data electrode 5-13 has a larger width in a region aligned with the portion of the display discharge electrode 8 extended from the bus electrode 4 in the vertical lower side than those in the other regions, For example, the width of the narrow portion of the data electrode 5-13 is set equal to 60 μm, and the width of the wide portion is set equal to 190 μm.

In general, an inter-plane discharge starting voltage is lower as the width of the data electrode superposed on the display discharge electrode is smaller. Thus, according to the thirteenth embodiment thus constructed, with respect to one display cell, an inter-plane discharge starting voltage with the display discharge electrode 8 located in the vertical upper side becomes lower. If the width of the date electrode 5-13 is set like that described above, for example, a difference of about 20 V can be obtained between inter-plane discharge starting voltages.

In the fourteenth embodiment, as shown in FIG. 11B, a vertically extended data electrode 5-14 is provided between display cells adjacent to each other in the horizontal direction. In other words, the data electrode 5-14 is provided below the vertical partition wall (not shown). In the data electrode 5-14, a portion is provided, which is protruded to a region aligned with the portion of the display discharge electrode 8 extended from the bus electrode 4 in the vertical lower side. Accordingly, the portion of the display discharge electrode 8 extended from the bus electrode 4 in the vertical lower side and the data electrode 5-14 are superposed on each other in an area larger than that in the first embodiment when seen from a plane. However, there is no superposition between the portion of the display discharge electrode 8 extended from the bus electrode 4 in the vertical upper side and the data electrode 5-14.

According to the fourteenth embodiment thus constructed, an inter-plane discharge starting voltage is extremely high between the display discharge electrode 8 extended from the bus electrode 4 in the vertical upper side and the data electrode 5-14 disposed below the vertical partition wall. Thus, a large difference can be set between this inter-plane discharge starting voltage and an inter-plane discharge starting voltage applied between the display discharge electrode 8 extended from the bus electrode in the vertical lower side and the data electrode 5-14.

In the fifteenth embodiment, as shown in FIG. 11C, a data electrode 5-15 is provided, which meanders between vertical partition walls 6*a* located in both sides of a display cell constituting a column. The data electrode 5-15 traverses the lower side of the display discharge electrode 8 extended from the bus electrode 4 in the vertical lower side in each display cell. In the data electrode 5-15, a wide bulged portion is formed in the region traversing the display discharge electrode 8.

According to the fifteenth embodiment thus constructed, as in the case of the fourteenth embodiment shown in FIG. 11B, with respect to the display discharge electrode 8 extended from the bus electrode 4 in the vertical upper side, the width of the data electrode 5-15 is narrow, and the date electrode 5-15 itself is disposed below the vertical partition wall 6*a*. Thus, an inter-plane discharge starting voltage in this region becomes extremely high compared with that between the display discharge electrode extended from the bus electrode 4 in the lower side and the region of the data electrode traversing the display discharge electrode 8. The bulged portion shown in FIG. 11C may not be always necessary in the region of the data electrode traversing the display discharge electrode 8. However, the presence of a bulged portion having a proper area is more advantageous as it facilitates the generation of inter-plane discharging.

In the thirteenth to fifteenth embodiments, the planar shape of the data electrode is adjusted. On the other hand, though the manufacturing process of the backside substrate or the like becomes complex, a three-dimensional structure can be employed to set high a discharge starting voltage between one display discharge electrode of the bus electrode and the data electrode. The three-dimensional structure may be made such that a distance from the display discharge electrode is made longer by disposing the data electrode of a portion targeted for a high discharge starting voltage away from the display discharge electrode more than the other portions, the dielectric layer of this portion is set thick or the like. In each of the sixteenth to eighteenth embodiments, such a three-dimensional structure is employed.

In the sixteenth embodiment, as shown in FIGS. 11D and 12A, a data electrode 5-16 is formed, which has a level difference provided so as to approach the front substrate side more than the other regions in a region A extended in the horizontal direction. The region A is orthogonal to the display discharge electrode 8 located in the vertical upper side in each display cell.

According to the sixteenth embodiment thus constructed, since the level difference is formed in the data electrode 5-16, with respect to one display cell, a distance between the display discharge electrode 8 located in the vertical upper side and the data electrode 5-16 is smaller than that between the display discharge electrode 8 located in the vertical lower side and the data electrode 5-16. Thus, an inter-plane discharge starting voltage becomes lower between the data electrode 5-16 and the display discharge electrode 8 located in the vertical upper side.

In the seventeenth embodiment, as shown in FIG. 12B, a dielectric layer 10-17 having a recess 10-17*a* is provided in the region A extended in the horizontal direction.

According to the seventeenth embodiment thus constructed, with respect to one display cell, between the vertical upper and lower sides of the bus electrode 4, distances between the display discharge electrodes 8 and the data electrode 5 are equal to each other. However, the dielectric layer 10-17 present therebetween is thinner in the vertical upper side. Thus, an inter-plane discharge starting voltage becomes lower between the data electrode 5 and the display discharge electrode 8 located in the vertical upper side.

Figure 12A:
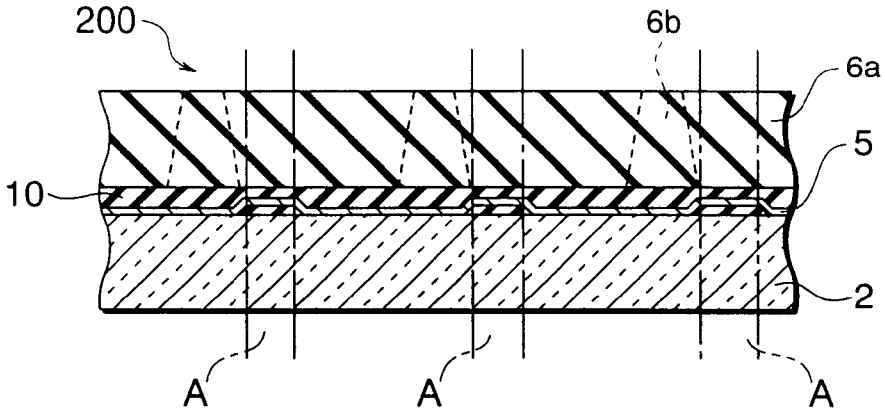
FIG. 12A is a sectional view showing a structure of the sixteenth embodiment.
Figure 12B:
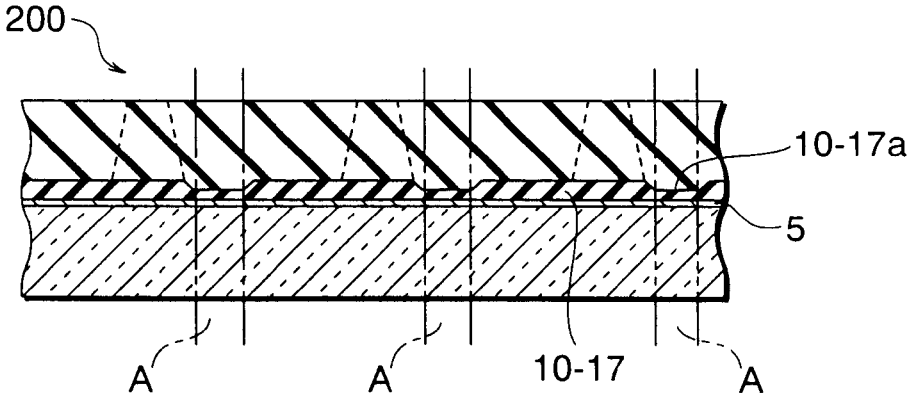
FIG. 12B is a sectional view showing a structure of a seventeenth embodiment.
Figure 12C:
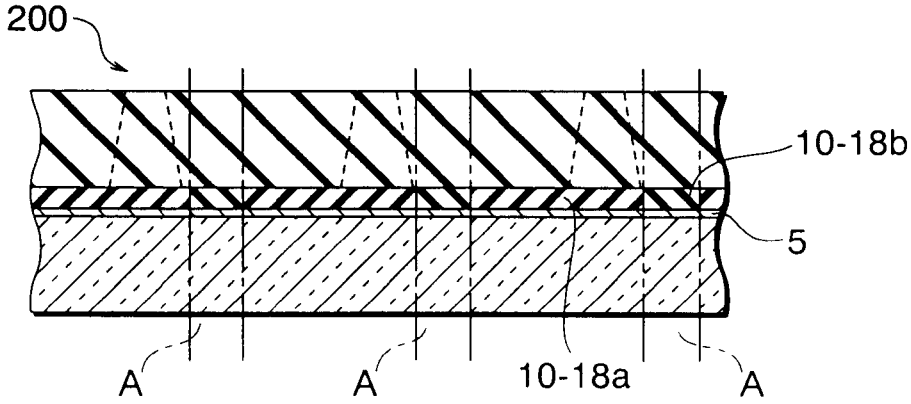
FIG. 12C is a sectional view showing a structure of an eighteenth embodiment.

In the eighteenth embodiment, as shown in FIG. 12C, a dielectric layer 10-18*a* is formed in the region A, and a dielectric layer 10-18*b* is formed in the other region. The dielectric constant of the dielectric layer 10-18*b* is higher than that of the dielectric layer 10-18*a*.

According to the eighteenth embodiment thus constructed, with respect to one display cell, between the vertical upper and lower sides of the bus electrode 4, distances between the display discharge electrodes 8 and the data electrode 5 are equal to each other. However, the dielectric layers 10-18*a* and 10-18*b* present therebetween are different from each other, in dielectric constants. Thus, an inter-plane discharge starting voltage becomes lower between the data electrode 5 and the display discharge electrode 8 located in the vertical upper side.

In the thirteenth to eighteenth embodiments, the discharge starting voltage is set lower between the display discharge electrode located in the vertical upper side and the data electrode in the display cell. However, by reversing the arrangements, a discharge starting voltage may be set lower between the display discharge electrode located in the vertical lower side and the data electrode in the display cell. In addition, by reversing the arrangements of the wide portion of the data electrode between the display discharge electrodes in the upper and lower sides of the bus electrode for each column, the region of a low discharge starting voltage may be reversed for each column. In the nineteenth embodiment, such an arrangement is employed.

Figure 11E:
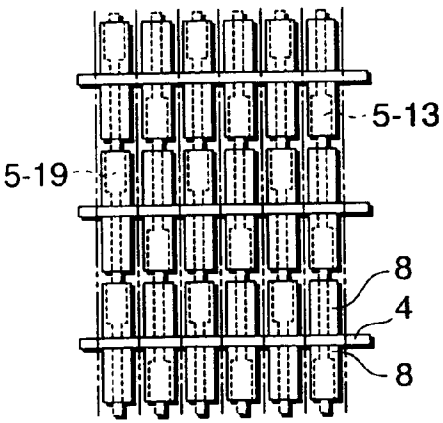
FIG. 11E is a schematic plan view showing a data electrode according to a nineteenth embodiment.

In the nineteenth embodiment, as shown in FIG. 11E, a data electrode 5-19 is formed, where the upper and lower directions of the data electrode 5-13 of the thirteenth embodiment are reversed for each column. Also in this case, an advantage similar to that of the thirteenth embodiment can be obtained by matching a driving method and a data array with such an arrangement.

With respect to one display cell, in the sixth to tenth embodiments, the shapes of the two display discharge electrodes are set different from each other; in the eleventh and twelfth embodiments, the dielectric layers have portions different in thickness; and in the thirteenth to nineteenth embodiments, the shapes of the data electrodes or the like, or the characteristics of the dielectric layers are set different from each other. Thereby, a difference is provided in inter-plane discharge starting voltages, discharging strengths or the like between the display discharge electrodes and the data electrode. By combining these embodiments, a larger difference can be provided in inter-plane discharge starting voltages. For practical use, in connection with the uniformity of the panel or the like, designing should preferably be made to secure a difference of 20 V or more in discharge starting voltages in the display cell.

Figure 13A:
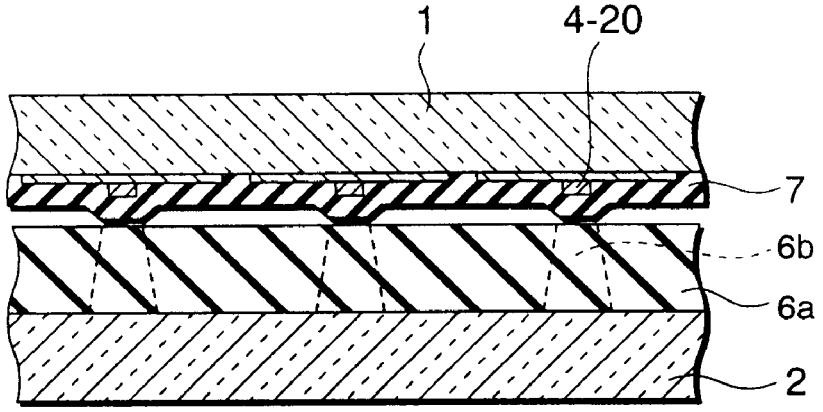
FIG. 13A is a sectional view showing a plasma display panel according to a twentieth embodiment.
Figure 13B:
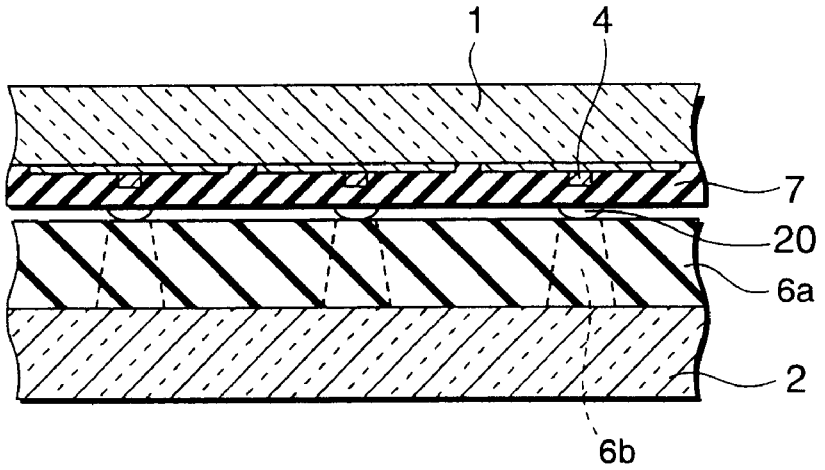
FIG. 13B is a sectional view showing a plasma display panel according to a twenty-first embodiment.

Next, twentieth to twenty-second embodiments of the invention will be described. In each of the twentieth to twenty-second embodiments, a gap is formed between the vertical partition wall and the front substrate. FIG. 13A is a sectional view showing a plasma display panel according to the twentieth embodiment; FIG. 13B a sectional view showing a plasma display panel according to the twenty-first embodiment; and FIG. 13C a sectional view showing a plasma display panel according to the twenty-second embodiment.

In the twentieth embodiment, as shown in FIG. 13A, a bus electrode 4-20 is provided, which is thicker by about twice than the bus electrode 4 in the first to nineteenth embodiments. The bus electrode 4-20 has a thickness of, e.g., about 10 $\mu$m. The bus electrode 4-20 is superposed on the horizontal partition wall 6*b* when seen from the plane. Then, a dielectric layer 7 is formed above the glass substrate 2 to cover the bus electrode 4-20. The dielectric layer 7 has a thickness of, e.g., about 25 $\mu$m. However, there is a level difference of about 7 $\mu$m between a portion overlapped by the bus electrode 4-20 and a portion not overlapped by the same. Accordingly, after the combination with the backside substrate 200, the dielectric layer 7 is tightly adhered to the horizontal partition wall 6*b* in the portion overlapped by the bus electrode 4-20. Because of the presence of the level difference, however, a gap is formed between the vertical partition wall 6*a* and the front substrate 100.

According to the twentieth embodiment thus constructed, since exhaust conductance is reduced in the manufacturing process, it is possible to shorten the time of exhaustion and surely remove impurities.

In the twenty-first embodiment, as shown in FIG. 13B, a belt-like swollen portion 20 is formed on the region of the dielectric layer 7 overlapped by the bus electrode 4. This swollen portion 20 can be formed, for example, by forming a glazed layer as the dielectric layer 7, then coating glazing paste again in a belt pattern by screen printing, and drying and baking this layer. The swollen portion 20 has a width of, e.g., 120 $\mu$m, and a height of, e.g., 17 $\mu$m. In addition, in the front substrate 100, a magnesium oxide thin film (not shown) is formed to cover the swollen portion 20.

According to the twenty-first embodiment thus constructed, by the swollen portion 20, a larger gap is secured between the front substrate 100 and the vertical partition wall 6*a*. As a result, it is possible to further shorten the time of exhaustion and further assure the removable of impurities.

The swollen portion may be formed before the formation of the dielectric layer 7 or before the formation of a double side in-plane discharge electrode though the manufacturing process nay become complex. In addition, for the swollen portion, a transparent material may be used. But for the purpose of improving bright spot contrast, a colored material may be used.

Figure 13C:
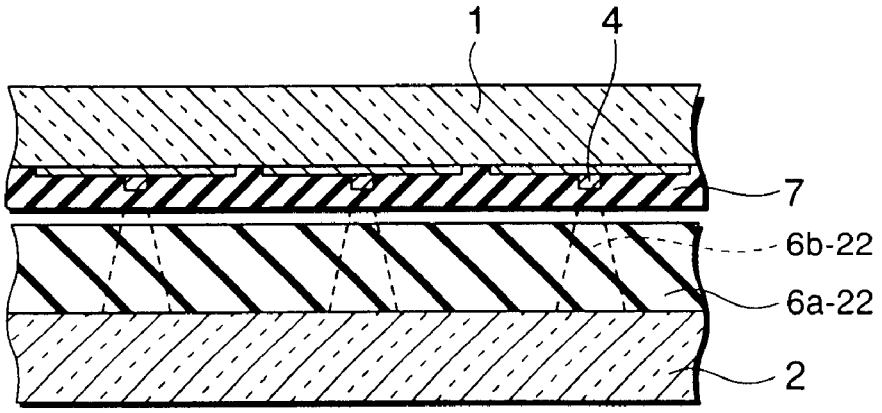
FIG. 13C is a sectional view showing a plasma display panel according to a twenty-second embodiment.

In the twenty-second embodiment, as shown in FIG. 13C, the height of a vertical partition wall 6*a*-22 is lower by about 20 μm than that of a horizontal partition wall 6*b*-22. Such partition walls 6*a*-22 and 6*b*-22 can be formed by, for example, forming vertical and horizontal partition walls equal to each other in height by sand blasting, and then providing a swollen belt-like portion on the horizontal partition wall by screen printing. Other than this method, photosensitive paste or a metallic mold having a three-dimensional shape may be used to form the partition walls 6*a*-22 and 6*b*-22.

Also, according to the twenty-second embodiment thus constructed, exhaust conductance is reduced.

When the partition walls 6*a*-22 and 6*b*-22 formed in the foregoing manner are used, if the coating of a phosphor layer is executed by screen printing, then phosphor paste easily enters the adjacent display cells. Thus, the phosphor paste should preferably be coated by a micro-dispenser or an ink jet method.

In addition, a larger gap between the vertical partition wall and the front substrate is more advantageous for exhaustion. If the gap is too large, however, the suppression of discharge interference may be insufficient to cause inconveniences such as erroneous lighting, reducing emitted light luminance. Thus, the size of the gap should preferably be set in the range of about 5 to 40 μm.

In each of the plasma display panels of the first to twenty-second embodiments, the display cells adjacent to each other in the vertical direction are plotted by the horizontal partition wall overlapped, seen from the plane, by the bus electrode connecting, in common, nearly the center parts of the double side in-plane discharge electrodes constituting a line. Thus, electric discharging on a certain display discharge electrode located in one side of the bus electrode can be prevented from spreading to the display discharge electrode in the other side.

Moreover, since the display discharge electrodes are effectively separated from each other between the display cells adjacent to each other in the horizontal direction, even if there is a gap between the upper surface of the vertical partition wall and the dielectric layer 7, discharge interference can be prevented between the adjacent display cells in the horizontal direction. Further, because of such effective separation of the display discharge electrodes, a driving advantage like that described later is provided.

Figure 14:
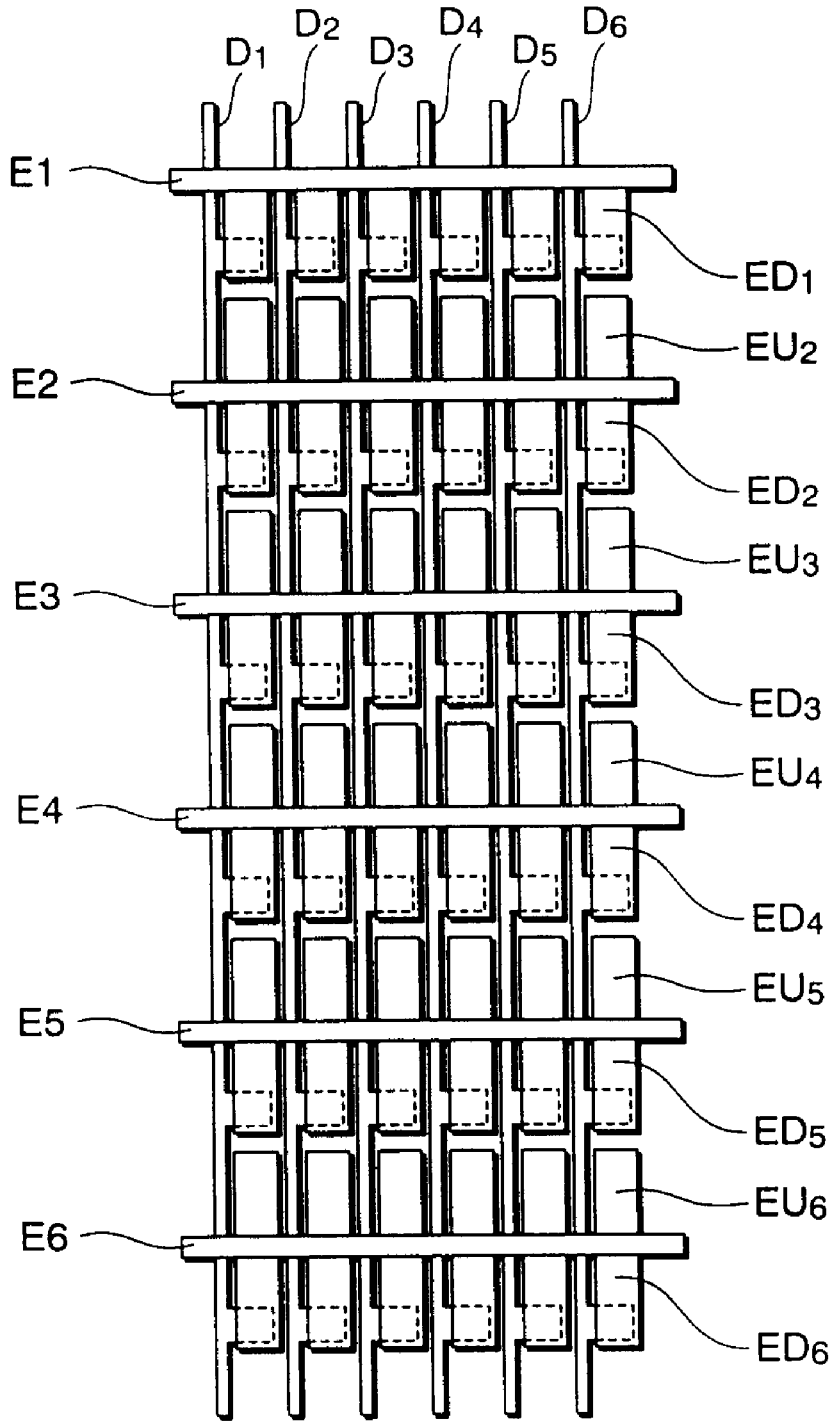
FIG. 14 is a schematic plan view showing a plasma display apparatus according to a twenty-third embodiment of the invention.

Next, description will be made of a plasma display apparatus provided with a plasma display panel like that in one of the foregoing embodiments of the invention and its driving device. FIG. 14 is a schematic plan view showing a plasma display apparatus according to a twenty-third embodiment of the invention.

The twenty-third embodiment incorporates an asymmetrical panel, where an inter-plane discharge starting voltage between one display discharge electrode of the double side in-plane discharge electrode and the data electrode is different from that between the other display discharge electrode and the data electrode. The asymmetrical panel is, as shown in FIG. 14, for example, a plasma display panel of the fourteenth embodiment shown in FIG. 11B.

FIG. 14 shows six double side in-plane discharge electrodes E1 to E6, and six data electrodes D1 to D6, which are equivalent to the left upper portion of the plasma display panel of the fourteenth embodiment. A display discharge electrode located in the upper side of the bus electrode of an n-th line from the uppermost line is denoted by EUn, and a display discharge electrode located in the lower side by EDn. For example, a display discharge electrode located in the upper side of the double side in-plane discharge electrode E3 of the third line is denoted by EU3, and a display discharge electrode located in the lower side thereof by ED3. A display discharge electrode is unnecessary in the upper side of the electrode E1 of the uppermost line, and only a display discharge electrode ED1 is provided in the lower side thereof. In addition, a driving device (not shown) is provided to supply voltages to these double side in-plane discharge electrodes and the data electrode.

According to the twenty-third embodiment thus constructed, the emitted light displaying of the first display line is carried out by light emission based on in-plane discharging between the electrodes ED1 and EU2; the displaying of the second display line by light emission based on in-plane discharging between the electrodes ED2 and EU3; and the displaying of the third display line by light emission based on in-plane discharging between the electrodes ED3 and EU4.

Figure 15:
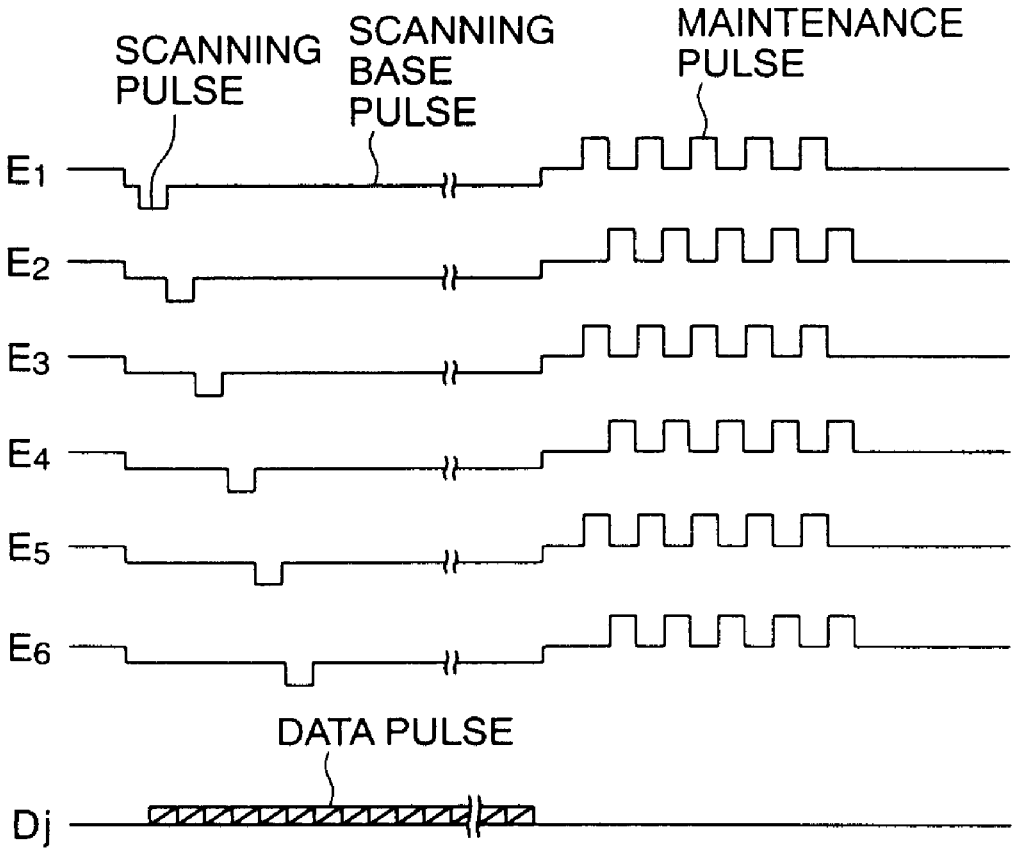
FIG. 15 is a timing chart showing a method for driving the twenty-third embodiment.

FIG. 15 is a timing chart showing a method for driving the twenty-third embodiment.

First, during writing, the driving device applies scanning pulses sequentially from the electrode E1 in the vertical direction, and a data pulse having polarity reverse to that of each scanning pulse to a data electrode Dj in synchronization with the scanning pulse according to display data. In this case, according to the embodiment, as shown in FIG. 14, in the display discharge electrode EDn disposed in the lower side of the bus electrode, inter-plane discharging occurs with the data electrode by a lower voltage than that in display discharge electrode EUn disposed in the upper side. Accordingly, by applying a proper scanning pulse and data pulse voltages, writing discharging can be generated only by the display discharge electrode EDn.

For example, when data pulses are applied to, e.g., data electrodes D2, D3 and D5 based on the display data of the third display line during the application of the scanning pulse to the electrode E3, and the data electrodes D1, D4 and D6 are at ground potentials, inter-plane discharging occurs between the display discharge electrode ED3 and the data electrodes D2, D3 and D5, and wall charges are generated near the selected display discharge electrode ED3. In this case, irrespective of the application of scanning pulses of similar voltages, no inter-plane discharging occurs between the display discharge electrode EU3 and the data electrode D2, D3 or D5. Thus, in the display cells thereof, no wall charges are generated near the display discharge electrode EU3. In addition, since the display discharge electrodes ED3 and EU3 are partitioned from each other by the horizontal partition wall 6*b*, even when electric discharging occurs in the display discharge electrode ED3, its spread to the display discharge electrode EU3 can be prevented.

After the end of writing, as shown in FIG. 15, the driving device applies a maintenance discharge pulse to each double side in-plane discharge electrode. The maintenance discharge pulse is applied such that an AC pulse is applied between the adjacent double side in-plane discharge electrodes. In-plane discharging occurs between the adjacent display discharge electrodes EDn and EUn+1 sandwiching an in-plane discharge gap only in display cells in which wall charges are generated. Because of the presence of the horizontal partition wall 6*b*, this maintenance discharging gives no mutual effects between the display cells adjacent to each other in the vertical direction. Similarly, because of the presence of the vertical partition wall 6*a* and the horizontally separated arrangement of the display discharge electrodes, no interference occurs between the display cells adjacent to each other in the horizontal direction.

By repeating such a series of driving operations for each sub-field, full-color displaying can be carried out.

In general, various preparation sequences such as preparation discharging or the like are employed to assure displaying. The use of such a preparation sequence is also advantageous for the driving of the embodiment. In the embodiment, wall charge generation is carried out by writing discharging. However, by using the preparation sequence to generate wall charges beforehand, and eliminating the wall charges by writing discharging in selected display cells, the advantage of the invention can also be obtained by employing an erasing/writing system for writing a negative image. Moreover, in the driving method of FIG. 15, a scanning base pulse is present. This scanning base pulse is not only capable of reducing a withstand voltage required of a scanning driver but also effective for increasing a driving margin, and it is set at a proper voltage.

Next, a twenty-fourth embodiment of the invention will be described. The twenty-fourth embodiment provides a plasma display apparatus designed to further increase a driving margin. In the twenty-third embodiment, as described above, voltages equal to each other are applied to the upper and lower adjacent ones of the double side in-plane discharge electrodes, to which the scanning pulses have been applied. In addition, a scanning base voltage has been set equal to 0 V, or a positive/negative value like that shown in FIG. 15. On the other hand, in the twenty-fourth embodiment, the voltages of one and the other double side in-plane discharge electrodes adjacent to the double side in-plane discharge electrode, the scanning pulse having been applied thereto, are set different from each other. For example, in the panel structure shown in FIG. 14, a voltage applied to the double side in-plane discharge electrode adjacent to the lower side of the double side in-plane discharge electrode, the scanning pulse having been applied thereto, is set to have a larger voltage difference with the voltage of the scanning pulse than a voltage applied to the double side in-plane discharge electrode adjacent to the upper side.

Figure 16:
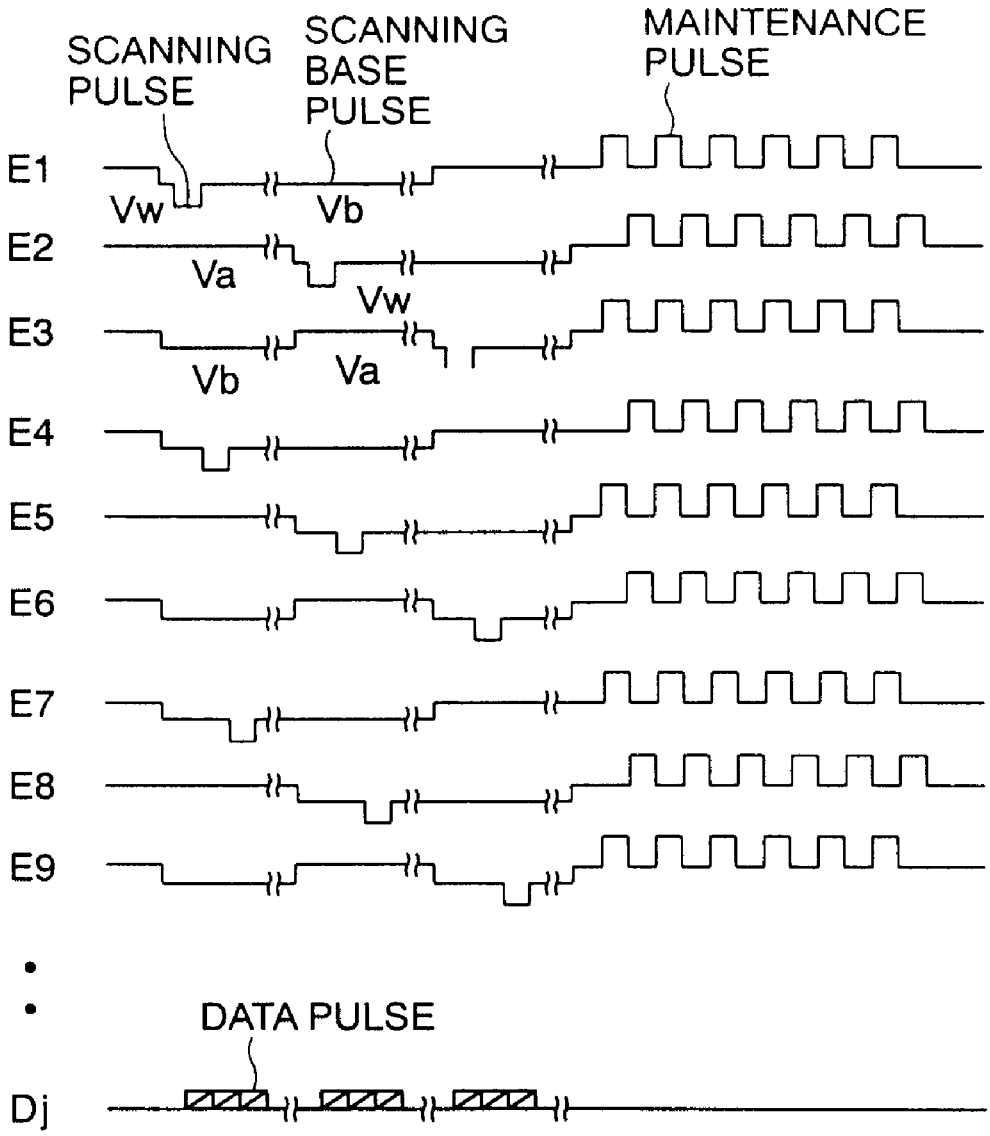
FIG. 16 is a timing chart showing a method for driving a twenty-fourth embodiment.

To supply voltages in such a manner, it is only necessary to apply a voltage having a three-phase driving waveform to each electrode by the driving device. FIG. 16 is a timing chart showing a method for driving the twenty-fourth embodiment.

In this driving method, double side in-plane discharge electrodes are defined into three groups: the first group of double side in-plane discharge electrodes E1, E4, E7, E10, and so on, the second group of double side in-plane discharge electrodes E2, E5 E8, E11, and so on, and the third group of double side in-plane discharge electrodes E3, E6, E9, E12, and so on.

During the application of scanning pulses to the double side in-plane discharge electrodes E1, E4, E7, E10, and so on, of the first group, a voltage Va is applied to the second group, and a voltage Vb to the third group. If the voltage of a scanning pulse is Vw, a voltage difference between the voltages Vw and Va is larger than that between the voltages Vw and Vb.

During the application of scanning pulses to the double side in-plane discharge electrodes E2, E5, E8, E11, and so on, of the second group, the driving device applies a voltage Vb to each of the double side in-plane discharge electrodes of the first group, and a voltage Va to each of the double side in-plane discharge electrodes of the third group. Then, during the application of scanning pulses to the double side in-plane discharge electrodes E3, E6, E9, E12, and so on, of the third group, the driving device applies a voltage Va to each of the double side in-plane discharge electrodes of the first group, and a voltage Vb to each of the double side in-plane discharge electrodes of the second group.

In such a three-phase scanning, as shown in FIG. 16, since the scanning pulses may be applied to E1, E4, and so on, E2, E5, and so on, and E3, E6, and so on, in this order, data pulses are applied to a data electrode Dj according to the order of this scanning. In the plasma display apparatus, the display data of one field are all stored as digital data. Accordingly, there will be no cost increases even if the order of this scanning is changed.

For example, the voltage Vw is set equal to −190 V; the voltage Va equal to 0 V; the voltage Vb equal to −90 V, the same as the scanning base voltage; and a data pulse voltage equal to 60 V. If each voltage value is set in this manner, for example, when the scanning pulse of −190 V is applied to the double side in-plane discharge electrode E4 and the data pulse of 60 V is applied to the data electrode, the voltage of 250 V is applied between the display discharge electrode ED4 and the data electrode, generating inter-plane discharging between these electrodes. In this case, the voltage of the double side in-plane discharge electrode E5 is 0 V, and with the inter-plane discharging used as a trigger and nearly simultaneously with the inter-plane discharging, strong in-plane discharging occurs because of the voltage difference of 190 V between the display discharge electrodes ED4 and EU5. This in-plane discharging enables a good writing state to be realized, bringing about sufficient wall charge storage.

On the other hand, if a sufficiently high inter-plane discharge starting voltage is set due to the shape of the data electrode and/or the display discharge electrode or the like while the voltage of the display discharge electrode EU4 is also −190 V by the scanning pulse application, no inter-plane discharging occurs between the display discharge electrode EU4 and the data electrode.

In addition, if an inter-plane discharge starting voltage is not high enough, or if certain inconvenience occurs, electric discharging may occur with data discharging. In such a case, however, since a voltage difference between the display discharge electrode EU4 and the ED3 is only 100 V, even when incorrect inter-plane discharging occurs between the data electrode and the display discharge electrode EU4, no in-plane discharging occurs by using the incorrect inter-plane discharging as a trigger. Thus, only a small amount of wall charges is stored, and a writing state is not reached. As a result, it is possible to increase a driving margin.

After the end of writing on the panel full surface, as shown in FIG. 16, the driving device applies a maintenance discharge pulse to each double side in-plane discharge electrode. The maintenance discharge pulse is applied by being phase-shifted from another such that an AC pulse can be applied between the double side in-plane discharge electrodes adjacent to each other. Then, emitted light displaying is carried out between the display discharge electrodes EDn and Eun+1 adjacent to each other sandwiching an in-plane discharge gap.

By repeating such a series of driving operations for each sub-field, full-color displaying can be carried out. To achieve stability, a high speed or the like for the writing operation, a proper preparation sequence such as preparation discharging or the like is also advantageous in the described embodiment.

Figure 17:
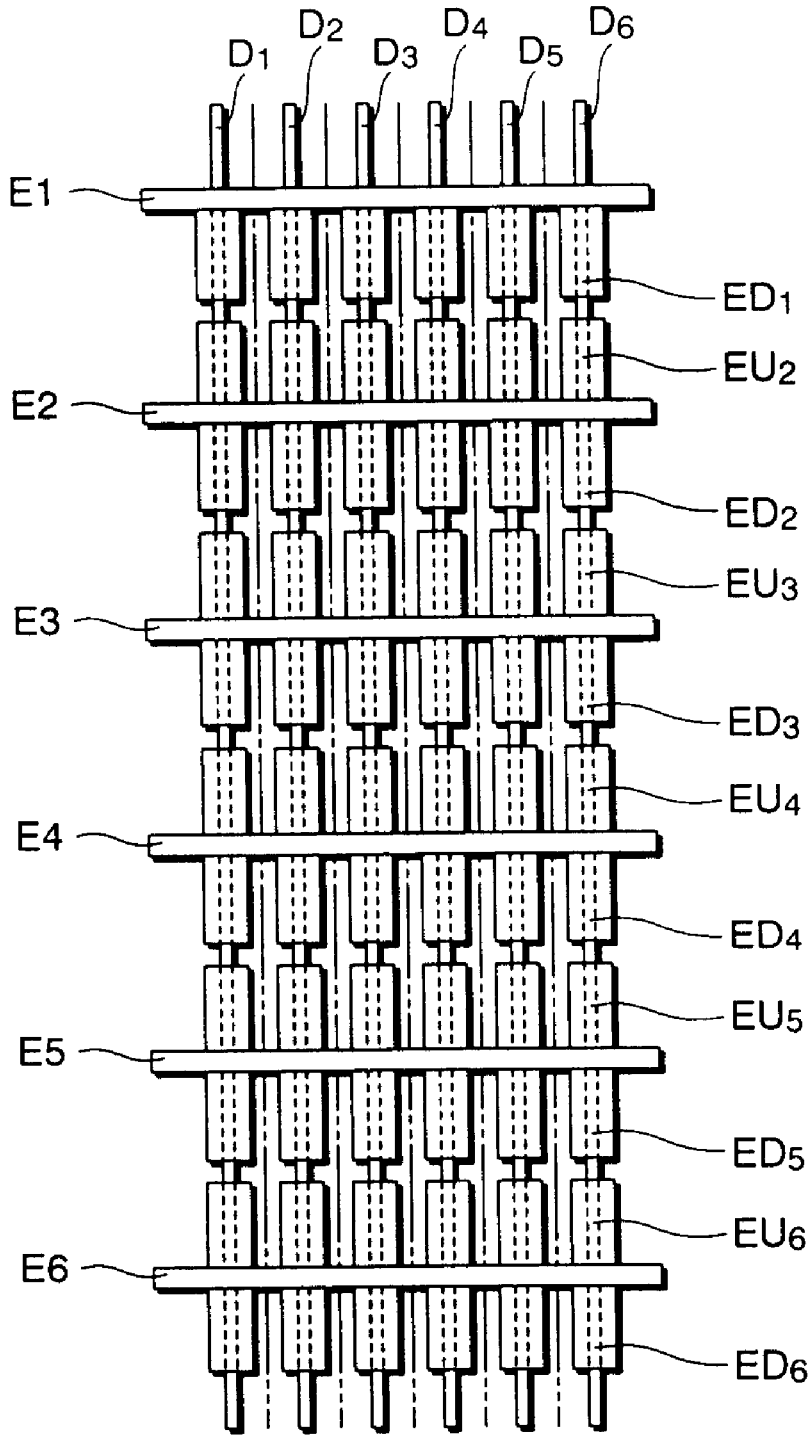
FIG. 17 is a schematic plan view showing a plasma display apparatus employing a symmetrical panel.

In addition, by employing the driving method of the twenty-fourth embodiment, though a driving margin is slightly reduced, it is possible to drive a symmetrical panel shown in FIG. 17, which is similar to that of the first embodiment. FIG. 17 is a schematic plan view showing a plasma display apparatus employing a symmetrical panel.

Figure 18:
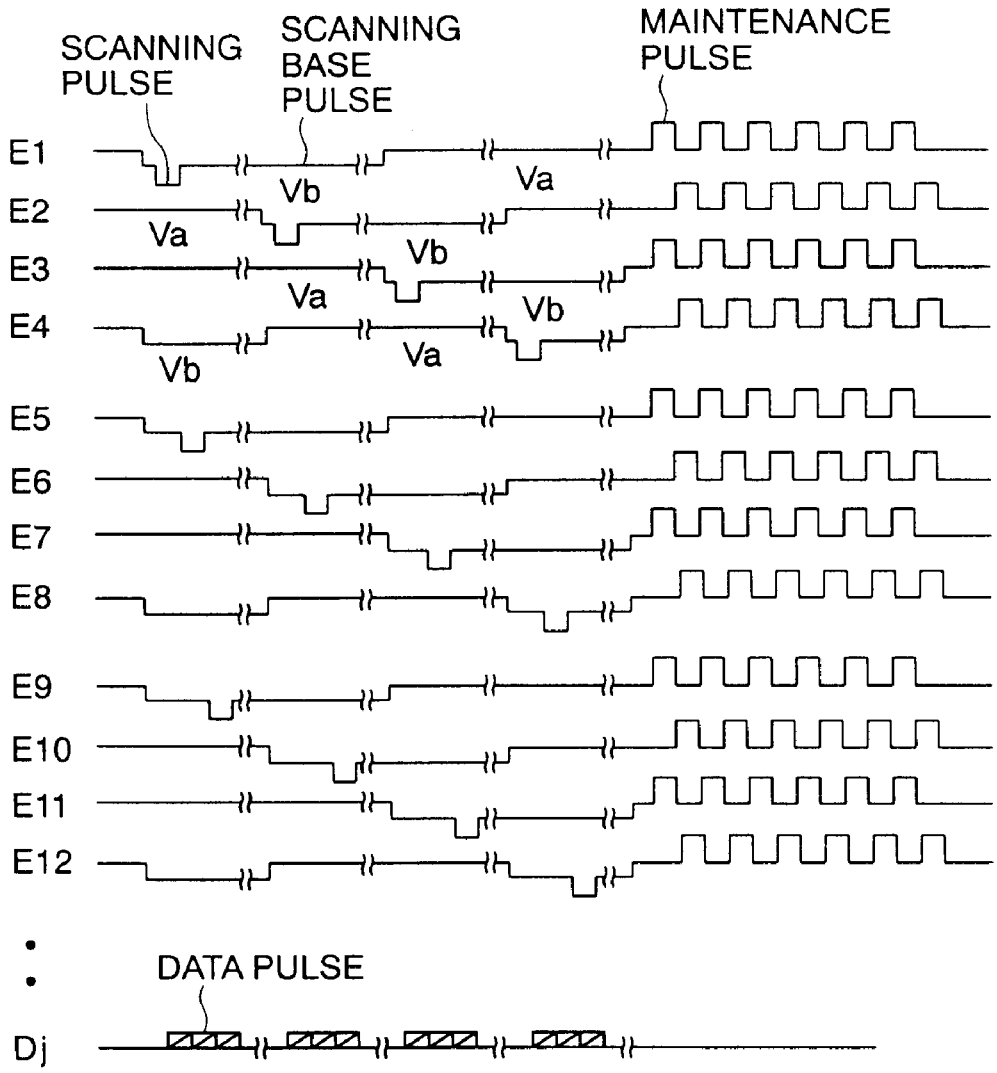
FIG. 18 is a timing chart showing a method for driving a twenty-fifth embodiment.

Further, in the twenty-fourth embodiment, the double side in-plane discharge electrodes are defined into the three groups. But the number of groups may be more. Now, description will be made of a twenty-fifth embodiment for four-phase driving carried out by defining the double side in-plane discharge electrodes into four groups. FIG. 18 is a timing chart showing a method for driving the twenty-fifth embodiment.

In the twenty-fifth embodiment, the double side in-plane discharge electrodes are defined into four groups: the first group of double side in-plane discharge electrodes E1, E5, E9, and so on, the second group of double side in-plane discharge electrodes E2, E6, E10, and so on, the third group of double side in-plane discharge electrodes E3, E7, E11, and so on, and the fourth group of double side in-plane discharge electrodes E4, E8, E12, and so on.

In the asymmetrical panel having the structure shown in FIG. 14, the driving device applies the voltage Va to the group adjacent to the lower side of the group, the scanning pulse having been applied thereto, and the voltage Vb to the group adjacent to the upper side. Then, the driving device applies the voltage Va, the voltage Vb or other proper voltages to the remaining groups. For example, the scanning pulse is set equal to −190 V, the voltage Va equal to 0 V, the voltage Vb equal to −90 V, the same as that of the scanning base voltage, and the voltages applied to the remaining groups equal to 0 V.

Also, according to the twenty-fifth embodiment thus constructed, after the end of writing, an AC maintenance pulse is applied between the double side in-plane discharge electrodes adjacent to each other to carry out emitted light displaying.

In the twenty-fourth embodiment employing the three-group driving method, two kinds of phases are necessary as the phases of maintenance pulses applied to the double side in-plane discharge electrodes of the same group. For example, in the double side in-plane discharge electrodes E1 and E4 of the same first group, the phases of maintenance pulses are different from each other, making it necessary to connect these electrodes to different pulse generation circuits. Consequently, a maintenance pulse generation circuitry may become complex.

On the other hand, in the twenty-fifth embodiment employing the four-group driving method, maintenance pulses having identical phases are applied to the double side in-plane discharge electrodes of the same group. Thus, the embodiment is advantageous in that a circuitry can be simplified.

The double side in-plane discharge groups may be defined into much more groups. However, no special advantages are thereby provided, and defining into the four groups is more than enough. As in the case of the twenty-fourth embodiment, the driving method of the twenty-fifth embodiment can be applied to the symmetrical panel.

Figure 19:
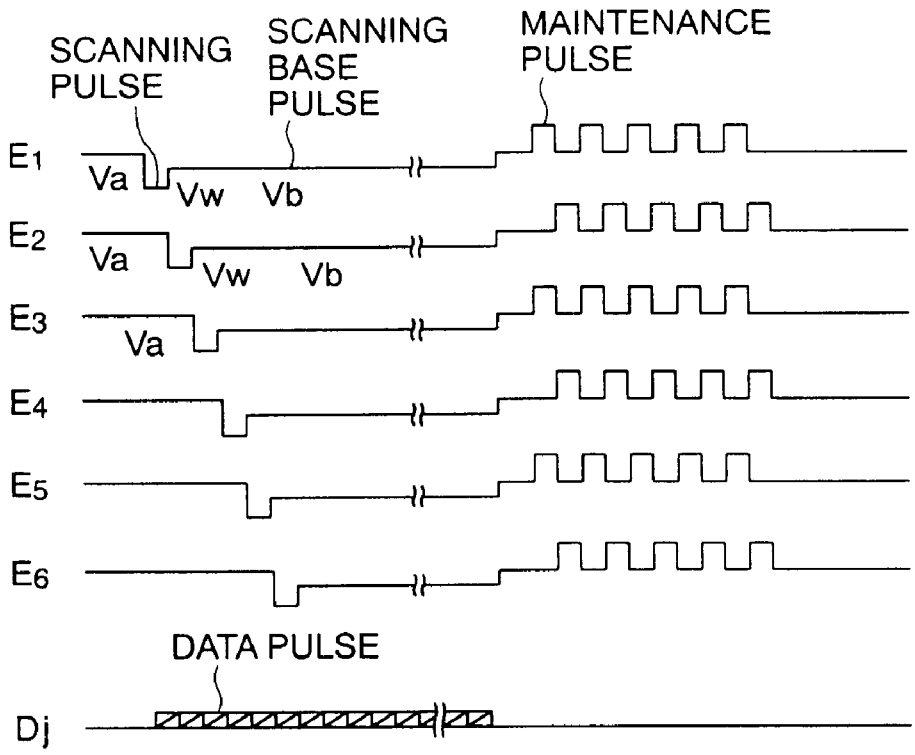
FIG. 19 is a timing chart showing a method for driving a twenty-sixth embodiment.

Next, a twenty-sixth embodiment of the invention will be described. FIG. 19 is a timing chart showing a method for driving the twenty-sixth embodiment. In the twenty-sixth embodiment, the driving device applies scanning pulses of voltages Vw to the double side in-plane discharge electrodes E1, E2, E3, and so on, in this order during scanning. A voltage applied to each double side in-plane discharge electrode before the application of the scanning pulse is set to the voltage Va, and a voltage applied to each double side in-plane discharge electrode after the application of the scanning pulse is set to the voltage Vb. A voltage difference between the voltages Vw and Va is larger than that between the voltages Vw and Vb.

According to the twenty-sixth embodiment employing such a driving method, the driving device applies the voltage Vb to the double side in-plane discharge electrode En−1 adjacent to the upper side of the double side in-plane discharge electrode En, the scanning pulse having been applied thereto, and the voltage Va to the double side in-plane discharge electrode En+1 adjacent to the lower side. For example, if the scanning pulse has been applied to the double side in-plane discharge electrode E3, the voltage Vb is applied to the double side in-plane discharge electrode E2, and the voltage Va to the double side in-plane discharge electrode E4.

For example, assuming that the scanning pulse is set equal to −190 V, the voltage Va equal to 0 V and the voltage Vb equal to −90 V, if the scanning pulse has been applied to the double side in-plane discharge electrode E3, there is an applied voltage difference of 190 V between the display discharge electrodes ED3 and EU4. However, an applied voltage difference is only 100 V between the display discharge electrodes EU3 and ED2. Accordingly, inter-plane discharging occurs between the display discharge electrode ED3 and the data electrode, and then by using this as a trigger, in-plane discharging occurs between the display discharge electrodes ED3 and EU4, realizing a good writing state. On the other hand, even when inter-plane discharging occurs between the display discharge electrode EU3 and the data electrode, no in-plane discharging occurs between the display discharge electrodes EU3 and ED2 using this as a trigger. Thus, a writing state is not realized.

After the end of all the writing operations, the driving circuit applies a maintenance pulse to each electrode to carry out emitted light displaying. By repeating this operation for each sub-field, full-color displaying is carried out. As in the case of the foregoing embodiment, the use of a preparation sequence can further assure the operation. Also in the twenty-sixth embodiment, the asymmetrical panel is more preferable to secure a driving Aging However, as in the cases of the twenty-fourth and twenty-fifth embodiments, the symmetrical panel can also be used.

Figure 20A:
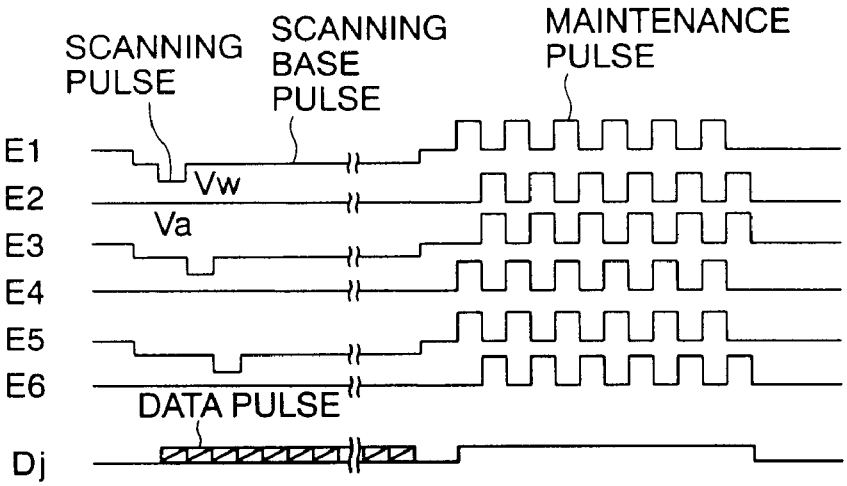
FIGS. 20A and 20B are views each showing a method for driving a twenty-seventh embodiment.
Figure 20B:
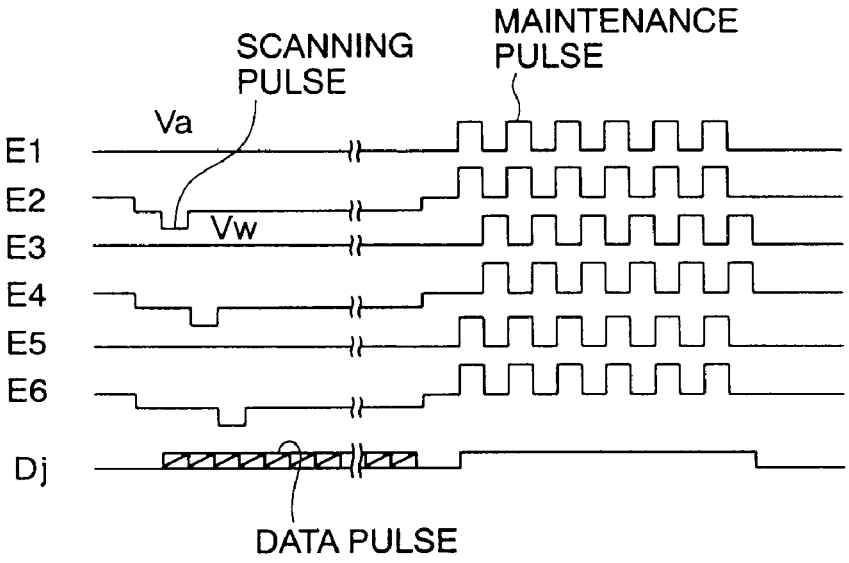

Next, a twenty-seventh embodiment of the invention will be described. In the plasma display apparatus of the twenty-seventh embodiment, interlaced displaying is carried out. Each of FIGS. 20A and 20B illustrates a method for driving the twenty-seventh embodiment: FIG. 20A a timing chart showing the driving waveform of an odd-numbered field, and FIG. 20B a timing chart showing the driving waveform of an even-numbered field.

For the displaying of the odd-numbered field, the driving device applies scanning pulses to every other electrode starting from the double side in-plane discharge electrode E1. During such scanning of the odd-numbered double side in-plane discharge electrode, the voltage of an even-numbered double side in-plane discharge electrode is fixed at a proper voltage Va. For example, the voltage of a scanning pulse is set equal to −190 V, a scanning base voltage equal to −90 V, and a voltage Va equal to 0 V.

According to the twenty-seventh embodiment employing such a driving method, for example, when a scanning pulse is applied to the double side in-plane discharge electrode E3, in the case of the asymmetrical panel shown in FIG. 14, inter-plane discharging occurs between the display discharge electrode ED3 and the data electrode. Then, by using this inter-plane discharging as a trigger, in-plane discharging occurs between the display discharge electrodes ED3 and EU4, realizing a good writing state. On the other hand, since no inter-plane discharging occurs between the display discharge electrode EU3 and the data electrode, a writing state is not realized.

After the writing end of the odd-numbered display cell in the foregoing manner, the driving device applies a maintenance pulse. For the maintenance pulse, the phase of a maintenance pulse applied to each double side in-plane discharge electrode is set such that an AC pulse can be applied between the display discharge electrodes constituting the display cell of the odd-numbered display line, and no maintenance pulses can be effectively applied to the display cell of the even-numbered display line. In other words, as shown in FIG. 20A, the double side in-plane discharge electrodes are defined into two groups: the first group of double side in-plane discharge electrodes E1, E4, E5, E8, E9, and so on, and the second group of double side in-plane discharge electrodes E2, E3, E6, E7, E10, E11, and so on. In the same group, maintenance pulses are applied by a timing of identical phases. Between the groups, maintenance pulses are applied by a timing of 180°-shifted phases. By such application of the maintenance pulses, only the display cell of the odd-numbered line is subjected to emitted light displaying.

Subsequently, as shown in FIG. 20B, the driving device applies scanning pulses to the even-numbered double side in-plane discharge electrodes E2, E4, and so on. In this case, the voltage of the odd-numbered double side electrode is set equal to 0 V. After the end of writing, the driving device applies a maintenance pulse in such a way as to apply an AC pulse to the display discharge electrode constituting the display cell of the even-numbered display line. In other words, the double side in-plane discharge electrodes are defined into two groups: the third group of double side in-plane discharge electrodes E1, E2, E5, E6, and so on, and the fourth group of double side electrodes E3, E4, E7, E8, and so on. In the same group, maintenance pulses are applied by a timing of identical phases. Between the groups, maintenance pulses are applied by a timing of 180°-shifted phases. In this way, only the display cell of the even-numbered line is subjected to emitted light displaying.

Thus, the displaying becomes interlaced, where the odd-numbered and even-numbered lines are separated for displaying, and repeated at a high speed, causing no visual problems. Displaying for a plurality of sub-fields must be carried out for full-color displaying. The displaying of the odd-numbered and even-numbered lines may be executed for each sub-field, or sub-field displaying may be executed for all the even-numbered lines after the end of the sub-field displaying for all the odd-numbered lines. Otherwise, these may be executed in a mixed manner.

According to the twenty-seventh embodiment, for example, writing is carried out only by the display discharge electrode located in the lower side of the bus electrode in a normal operation. However, even when incorrect writing discharging occurs with the data electrode in the display discharge electrode located in the upper side of the bus electrode for one inconvenience or another, and in-plane discharging occurs to reach a strong writing state, since the phases of maintenance pulses applied to the two display discharge electrodes are identical in this display cell, no maintenance discharging occurs. Thus, erroneously lit displaying never occurs.

Therefore, even when the twenty-seventh embodiment is applied to a symmetrical panel like that shown in FIG. 17, erroneous lighting can be prevented. For example, when a scanning pulse is applied to the double side display discharge electrode E3 in the odd-numbered field, inter-plane discharging may occur not only between the data electrode and the display discharge electrode ED3 but also between the data electrode and the display discharge electrode EU3 and, with this used as trigger, in-plane discharging also occurs. Accordingly, writing may be enabled for both of the display discharge electrodes ED3 and EU3. However, in the twenty-seventh embodiment, because of the phase relation of maintenance pulses, maintenance discharging occurs only between the display discharge electrodes ED3 and EU4, while no maintenance discharging occurs between the display discharge electrodes EU3 and ED2.

Therefore, normal displaying is realized even when the embodiment is applied to the symmetrical panel. However, the asymmetrical panel is more preferable in that since no unnecessary writing discharging occurs, even a scanning driver having a low current supplying capability can be used.

In the twenty-seventh embodiment, the time of scanning is equal to that in the conventional case. However, since maintenance light emission is carried out separately between the odd-numbered and even-numbered display lines, though the period of maintenance is made longer, the embodiment is advantageous in the following respects: a larger operation margin, the permission of using the symmetrical panel, the dispersion of maintenance discharge power, and so on.

Figure 21A:
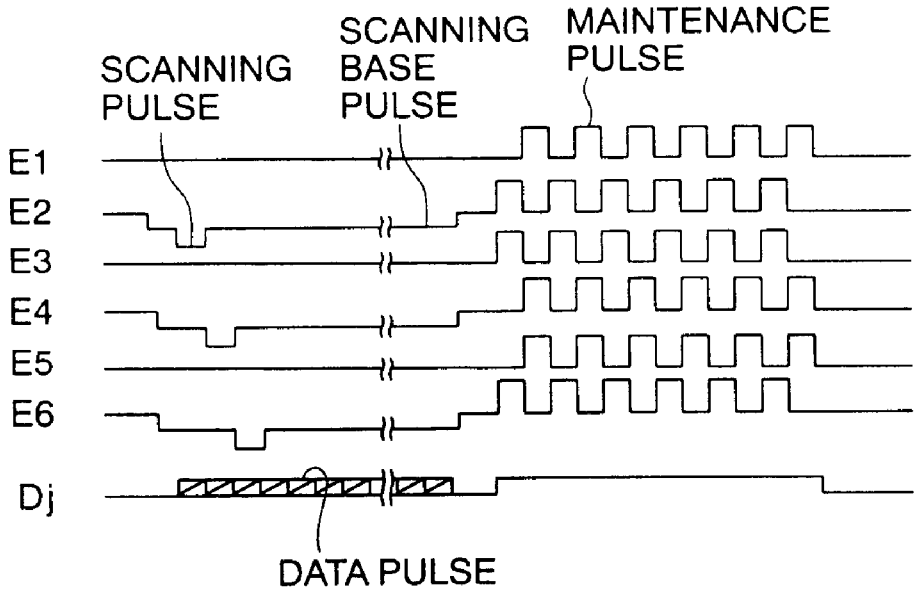
FIGS. 21A and 21B are views each showing a method for driving a twenty-eighth embodiment.
Figure 21B:
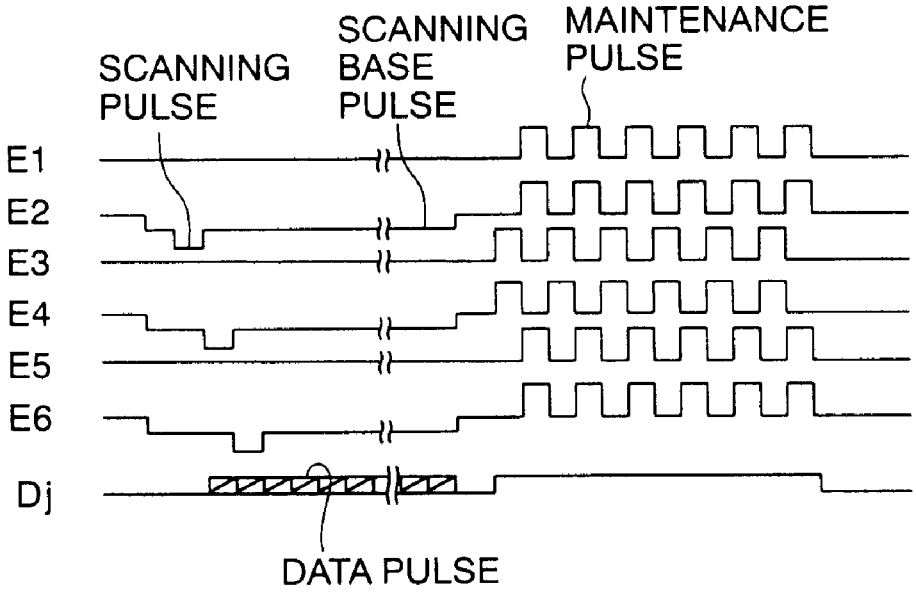

Next, description will be made of a twenty-eighth embodiment designed to halve the number of scanning drivers by using interlaced driving. The twenty-eighth embodiment is applied to the symmetrical panel shown in FIG. 17. Each of FIGS. 21A and 21B illustrates a method for driving the twenty-eighth embodiment: FIG. 21A a timing chart showing the driving waveform of an odd-numbered field, and FIG. 21B a timing chart showing the driving waveform of an even-numbered field.

As shown in FIG. 21A, for example, when the double side in-plane discharge electrode E2 is scanned, writing is executed not only in the first line with the display discharge electrode EU2 but also in the second display line with the display discharge electrode ED2 based on the display data for the first display line. However, by a maintenance pulse subsequently applied continuously, only the display cell of an odd-numbered line is subjected to maintenance light emission.

In the next displaying of the even-numbered field, as in the case of the displaying of the odd-numbered field, the driving device applies a scanning pulse to the even-numbered double side in-plane discharge electrode. With regard to the timing of scanning and data pulses, in the displaying of the odd-numbered field, a data pulse is applied to the data electrode based on the display data of the first display line, for example, when a scanning pulse is applied to the double side in-plane discharge electrode E2. In the displaying of the even-numbered field, when a scanning pulse is applied to the double side in-plane discharge electrode E2, a data pulse is applied to the data electrode based on the display data of the second display line. Accordingly, also for this scanning, in both of the display discharge electrodes EU2 and ED2, inter-plane discharging occurs with the data electrode and, with this used as a trigger, in-plane discharging occurs, realizing a writing state. As shown in FIG. 21B, however, since an AC maintenance pulse is applied only to the display cell for the even-numbered display line, for example, maintenance discharging occurs between the display discharge electrodes ED2 and EU3, while no maintenance discharging occurs between the display discharge electrodes EU2 and ED1.

As a result, in the displaying of the odd-numbered field, writing in the display discharge electrode located in the upper side of the bus electrode becomes valid for maintenance discharge light emission. In the displaying of the even-numbered field, writing in the display discharge electrode located in the lower side of the bus electrode becomes valid for maintenance discharge light emission.

According to such a driving method, only by applying a scanning pulse to the even-numbered double side in-plane discharge electrode, displaying can be executed on the full surface of the panel. Thus, the number of scanning drivers can be halved, contributing to lower costs. Moreover, the employment of a preparation sequence, and the combination of the displaying of the odd-numbered field, the displaying of the even-numbered field and the sub-field displaying can be made optionally.

In addition, the embodiment employs the structure having the scanning driver connected only to the even-numbered double side in-plane discharge electrode. However, by matching the phase relations of maintenance pulses, the scanning driver may be connected only to the odd-numbered double side in-plane discharge electrode. But since number of the display lines is generally an even, in this case a reduction equivalent to one bit can be made, the connection of the scanning driver to the even-numbered line is more preferable.

Figure 22A:
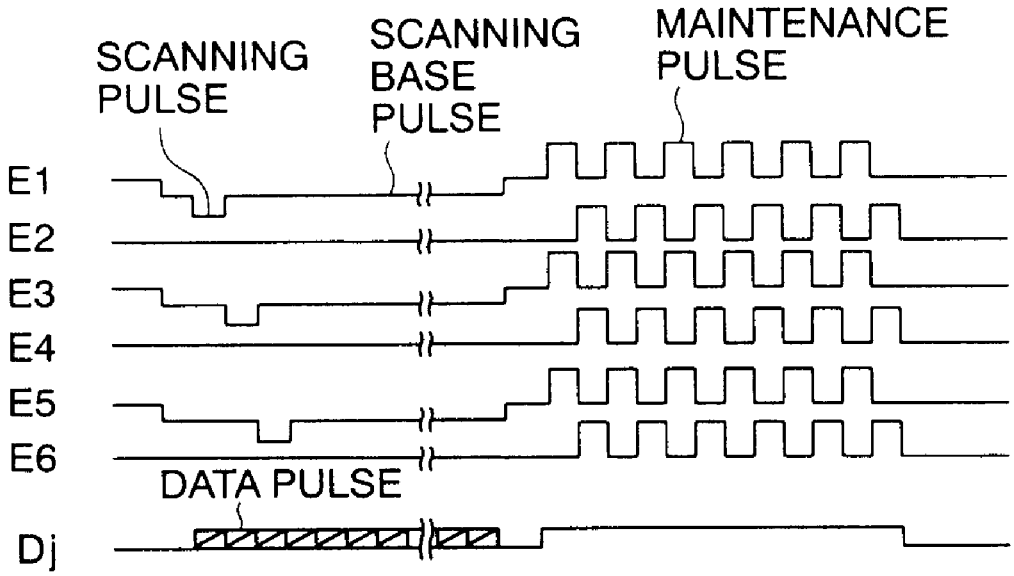
FIGS. 22A and 22B are views each showing a method for driving a twenty-ninth embodiment.

Next, description will be made of a twenty-ninth embodiment designed to carry out similar emitted light displaying for two adjacent display lines. The twenty-ninth embodiment is applied to a symmetrical panel having double side in-plane discharge electrodes. Each of FIGS. 22A and 22D illustrates a method for diving the twenty-ninth embodiment: FIG. 22A a timing chart showing the driving waveform of an odd-numbered field, and FIG. 22B a timing chart showing the driving waveform of an even-numbered field.

In the twenty-ninth embodiment, as shown in FIG. 22A, for the displaying of the odd-numbered field, the driving device applies a scanning pulse to odd-numbered double side in-plane discharge electrodes. In the present embodiment, since the symmetrical panel is used, for example, when a data pulse is applied to the data electrode by a timing for the application of a scanning pulse to the double side in-plane discharge electrode E3, the display discharge electrodes ED3 and EU3 are both placed in writing states. Then, after such scanning of the odd-numbered double side in-plane discharge electrode is carried out for the entire panel, as shown in FIG. 22A, the driving device applies an AC maintenance pulse between the double side in-plane discharge electrodes adjacent to each other. In this case, since writing is executed in display discharge electrodes in both sides of the odd-numbered double side in-plane discharge electrode, maintenance light emission occurs for the two display lines in similar emitted light displaying states.

Figure 22B:
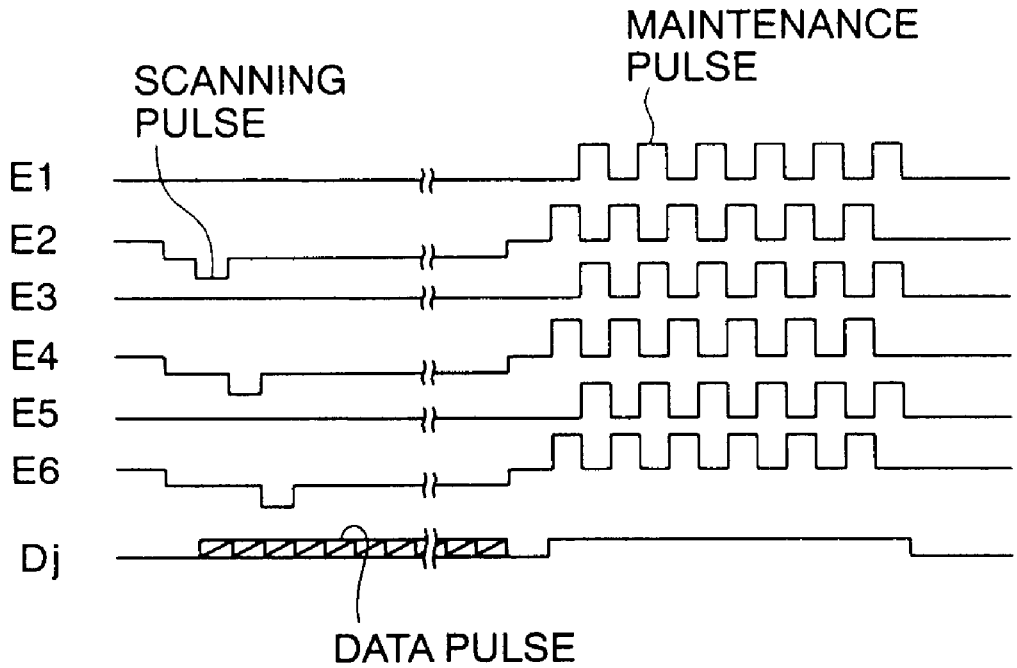

Then, as shown in FIG. 22B, for the displaying of the even-numbered field, the driving device applies a scanning pulse to even-numbered double side in-plane discharge electrodes, carries out writing in the display discharge electrodes located in both sides thereof, and then applies a maintenance pulse. Since the maintenance pulse is applied as an AC maintenance pulse between the double side in-plane discharge electrodes adjacent to each other, maintenance light emission occurs for the two display lines in similar emitted light displaying states.

Such a displaying method is equivalent to the interlaced displaying method of an alternate two-line scanning type, and thus resolution is slightly reduced. However, different from the twenty-third and twenty-fourth embodiments, where maintenance light emission is carried out only in half the display lines, maintenance light emission is carried out by all the lines of the panel. Therefore, high-luminance light emission is realized.

In addition, since interlaced emitted light displaying is superposed one another, for example, even when interlaced displaying is executed for one frame by 1/30 sec., as in the case of a conventional television set, interference by flickering and a scanning line structure can be suppressed. In this case, even compared with normal 1/60 sec., sequential scanning, there is sufficient time for scanning and maintenance light emission. Therefore, luminance can be increased, and costs can be reduced.

Thus, the twenty-ninth embodiment has high compatibility with television displaying, where video data is transmitted in an interlaced manner. Moreover, since high-luminance and high-resolution displaying can be realized, by employing the alternate two-line scanning driving method of the twenty-ninth embodiment for television displaying, and automatically switching the driving method to the method in any one of the twenty-second to twenty-sixth embodiments when displaying by a personal computer or the like is carried out, clear displaying having high resolution but no line flickering can also be formed.

In the plasma display apparatus of each of the foregoing embodiments, the scanning driver (driving device) may be connected to all the double side in-plane discharge electrodes. Alternatively, the scanning driver may be connected to half the number of all the double side in-plane discharge electrodes. Otherwise, scanning pulses may be applied based on the definition into multiple phases. In any case, it is preferred that the terminals of double side in-plane discharge electrodes from the panel be taken out alternately left and right, and connected to the driving device. The reason for this is to eliminate the left and right distribution of the intensity of maintenance emitted light. To be exact, the terminals may be connected from left and right alternately with the external driving circuit for supplying a maintenance pulse. However, since a maintenance pulse is also supplied through the output terminal of the scanning driver integrated circuit (IC), also in these embodiments having the scanning driver connected to all the electrodes, it is preferred that the terminals are taken out alternately left and right, and connected to the driving device.

The plasma display panel according to the present invention is similarly applicable to the structure where the data electrodes are defined into upper and lower sides, and panel two-division scanning is performed. Moreover, as in the case of the conventional plasma display apparatus, the plasma display panel according to the present invention is capable of increasing a display capacity and reducing data pulse application power by dual scanning.

The example of the driving waveform of each shown embodiment shows a relatively simple waveform for convenience of explanation. In the plasma display of AC driving, however, since relative potentials are important, and a bias effect provided by wall charges can be used, including a preparation sequence, waveform designing utilizing a proper bias can be carried out. In such a case, even a waveform different from that described above with reference to each shown embodiment can be easily designed. If a waveform like that taught by each of the foregoing embodiments is designed, then an advantage similar to that of the invention can be obtained.

Furthermore, in each of the foregoing embodiments, descriptions were made to specify the members of the odd and even numbers, the upper and lower sides, the vertical and horizontal directions, the odd-numbered and even-numbered fields, and so on. These are for easier understanding of the content of the invention. In other words, the descriptions are not intended to place any strict regulations, and the invention is not limited to the described members. In addition, in the case of the asymmetrical panel, it is only necessary to match a driving waveform with the disposition of a display discharge electrode having a low writing discharge voltage. Thus, the constitution of the plasma display apparatus is not limited to one shown in FIG. 14, and can incorporate the plasma display panel of the other embodiment.

What is claimed is:

1. A plasma display panel, comprising:

first and second substrates disposed oppositely to each other;

a parallel-crossed partition wall which defines a space between said first and second substrates into a plurality of display cells;

a plurality of bus electrodes provided in a side of said first substrate opposite said second substrate, said bus electrodes being superposed on a portion of said partition wall extended in a line direction when seen from a plane;

a plurality of pairs of first and second display discharge electrodes each extended from each of said bus electrodes in each of said display cells defined in a columnar direction by a portion of said partition wall overlapping with one of said plurality of bus electrodes when seen from the plane; and a plurality of data electrodes provided in a side of said second substrate opposite said first substrate and extended in the columnar direction, wherein a discharge starting voltage between a first display discharge electrode of one of said plurality of pairs of display discharge electrodes and a corresponding one of said plurality of data electrodes has a higher amplitude than a discharge starting voltage between a second display discharge electrode of said pair of display discharge electrodes and said corresponding data electrode.

2. The plasma display panel of claim 1, wherein said first display discharge electrode and said second display discharge electrode have shapes different from each other.

3. The plasma display panel of claim 1, wherein a projection portion having electrical conductivity is provided on said first display discharge electrode.

4. The plasma display panel of claim 1, wherein shapes of said data electrodes are different from each other between a portion opposite said first display discharge electrode and a portion opposite said second display discharge electrode.

5. The plasma display panel of claim 4, wherein areas of said data electrodes are different from each other between said portion opposite said first display discharge electrode and said portion opposite said second display discharge electrode.

6. The plasma display panel of claim 4, wherein said portion of said corresponding data electrode opposite said first display discharge electrode is disposed from the center of one of said plurality of display cells in a side of a portion extended in the columnar direction of said partition wall, and said portion of said corresponding data electrode opposite said second display discharge electrode has a region superposed on the center of said one display cell and wider than said portion opposite said first display discharge electrode.

7. The plasma display panel of claim 4, wherein a distance between said portion of said corresponding data electrode opposite said first display discharge electrode and said first display discharge electrode is different from a distance between said portion of said corresponding data electrode opposite said second display discharge electrode and said second display discharge electrode.

8. The plasma display panel of claim 1, further comprising a dielectric layer provided in the side of said first substrate opposite said second substrate, said dielectric layer covering said bus electrodes and said display discharge electrodes, and having difference in thickness between a portion on said first display discharge electrode and a portion on said second display discharge electrode.

9. The plasma display panel of claim 1, further comprising a dielectric layer provided in the side of said first substrate opposite said second substrate, said dielectric layer covering said bus electrodes and said display discharge electrodes, and having different dielectric constants between a portion on said first display discharge electrode and a portion on said second display discharge electrode.

10. The plasma display panel of claim 1, further comprising a dielectric layer provided in the side of said first substrate opposite said second substrate, said dielectric layer covering said bus electrodes and said display discharge electrodes, and having different secondary electron emission coefficients on a surface between a portion on said first one display discharge electrode and a portion on said second display discharge electrode.

11. The plasma display panel of claim 1, further comprising a dielectric layer provided in the side of said first substrate opposite said second substrate, said dielectric layer covering said bus electrodes and said display discharge electrodes, a region of said dielectric layer superposed on said one of said plurality of bus electrodes when seen from a plane being brought into contact with a line-direction extended portion of said partition wall, and a gap being formed between said dielectric layer and at least a part of a columnar-direction extended portion of said partition wall.

12. The plasma display panel of claim 8, wherein a region of said dielectric layer superposed on said one of said plurality of bus electrodes when seen from a plane is brought into contact with a line-direction extended portion of said partition wall, and a gap is formed between said dielectric layer and at least a part of a columnar-direction extended portion of said partition wall.

13. The plasma display panel of claim 11, wherein a surface of a portion of said dielectric layer covering said one of said plurality of bus electrodes is swollen due to said one bus electrode.

14. The plasma display panel of claim 11, further comprising a swollen portion formed between said one of said plurality of bus electrodes and said first substrate or said dielectric layer, or formed on said region of said dielectric layer superposed on said one bus electrode when seen from the plane.

15. The plasma display panel of claim 11, wherein said line-direction extended portion of said partition wall is higher than said columnar-direction extended portion.

16. The plasma display panel of claim 1, wherein said bus electrodes adjacent to each other are connected to an external driving circuit which alternately supplies maintenance pulses of opposite phases.

17. A plasma display apparatus comprising said plasma display panel of claim 1, said plasma display apparatus further comprising:

a driving device which applies AC pulses to two of said plurality of display discharge electrodes provided in each of said display cells after execution of writing discharge between said corresponding data electrode and said second display discharge electrode in said display cell.

18. A plasma display apparatus comprising said plasma display panel of claim 1, said plasma display apparatus further comprising:

a driving device which applies a scanning pulse to one of said plurality of bus electrodes, the scanning pulse having first and second voltages different from each other to two other of said plurality of bus electrodes adjacent to said one of said plurality of bus electrodes which is applied with said scanning pulse during a scanning period, and then applies alternating current pulses to two of said plurality of said display discharge electrodes provided in each of said display cells.

19. The plasma display apparatus according to claim 18, wherein said bus electrodes are defined into first, second and third groups for every third bus electrode, said first voltage being applied to said second group and said second voltage being applied to said third group while said scanning pulse is applied to said first group.

20. The plasma display apparatus according to claim 18, wherein said bus electrodes are defined into four or more groups for every fourth or more bus electrode, said first voltage being applied to one of said groups and said second voltage being applied to another one of said groups while said scanning pulse is applied to another one of said groups.

21. The plasma display apparatus according to claim 18, wherein during said scanning period, said driving device supplies said first voltage to each of said bus electrodes before application of said scanning pulse, and said second voltage to the same after the application of said scanning pulse.

22. A plasma display apparatus for performing interlaced displaying by setting an odd-numbered field and an even-numbered field comprising said plasma display panel of claim 1, said plasma display apparatus further comprising:

a driving device which applies, a scanning pulse to odd-numbered ones from the top of said bus electrodes, and maintenance pulses being identical and different in phase for every two adjacent ones of said bus electrodes after applying said scanning pulse to all said odd-numbered bus electrodes, in the case of displaying of said odd-numbered field, and a scanning pulse to even-numbered ones from the top of said bus electrodes, and maintenance pulses being identical and different in phase for every two adjacent ones of said bus electrodes after applying said scanning pulse to all said even-numbered bus electrodes, in the case of displaying of said even-numbered field.

23. A plasma display apparatus for performing interlaced displaying by setting an odd-numbered field and an even-numbered field comprising said plasma display panel of claim 1, said plasma display apparatus further comprising:

a driving device which applies, a scanning pulse to odd or even-numbered ones from a top of said bus electrodes, and maintenance pulses being identical and different in phase for every two adjacent ones of said odd or even-numbered bus electrodes, in the case of displaying of said odd-numbered field, and a scanning pulse to even or odd-numbered ones from the top of said bus electrodes, and a data pulse to said one data electrode based on display data of a display line shifted by one, and maintenance pulses being identical and different in phase for every two adjacent ones of said bus electrodes after applying said scanning pulse to all said even or odd-numbered bus electrodes, in the case of displaying of said even-numbered field.

24. A plasma display apparatus for performing interlaced displaying by setting an odd-numbered field and an even-numbered field comprising said plasma display panel of claim 1, said plasma display apparatus comprising:

a driving device which applies, a scanning pulse to odd-numbered ones from the top of said bus electrodes, and mutually reversed AC maintenance pulses to two adjacent ones of said bus electrodes after applying said scanning pulse to all said odd-numbered bus electrodes, in the case of displaying of said odd-numbered field, and a scanning pulse to even-numbered ones from the top of said bus electrodes, and mutually reversed AC maintenance pulses to two adjacent ones of said bus electrodes after applying said scanning pulse to all said even-numbered bus electrodes, in the case of displaying of said even-numbered field.

25. A plasma display apparatus comprising said plasma display panel according to claim 1, said plasma display apparatus further comprising:

a driving device comprising a selector, that selects voltages applied to said plasma display panel, wherein said driving device applies a scanning pulse to odd-numbered ones from the top of said bus electrodes, and mutually reversed AC maintenance pulses to two adjacent ones of said bus electrodes after applying said scanning pulse to all said odd-numbered bus electrodes, in the case of displaying of said odd-numbered field, and wherein said driving device applies a scanning pulse to even-numbered ones from the top of said bus electrodes, and mutually reversed AC maintenance pulses to two adjacent ones of said bus electrodes after applying said scanning pulse to all said even-numbered bus electrodes, in the case of displaying of said even-numbered field.

26. A plasma display apparatus comprising said plasma display panel according to claim 1, said plasma display apparatus further comprising:

a driving device comprising a selector, that selects voltages applied to said plasma display panel, wherein said driving device applies AC pulses to two of said plurality of said display discharge electrodes provided in each of said display cells after execution of a writing discharge between said corresponding data electrode and said second display discharge electrode in said display cell.

27. A plasma display panel, comprising:

first and second substrates disposed oppositely to each other;

a parallel-crossed partition wall defining a space between said first and second substrates into a plurality of display cells arrayed in row and column directions;

a plurality of bus electrodes provided on said first substrate and being superposed on such a portion of said partition wall that extends in said row direction;

a plurality of pairs of first and second display discharge electrodes coupled to each of said plurality of bus electrodes such that the first display discharge electrode extends from one of said plurality of bus electrodes into an area of one of said plurality of display cells adjacent to said one of said plurality of bus electrodes in said column direction and the second display discharge electrode extends from said one of said plurality of bus electrodes in an opposite direction from said first display discharge electrode in said column direction into an area of another one of said plurality of display cells adjacent to said one of said plurality of bus electrodes and adjacent to said one of said plurality of display cells in said column direction, wherein each of said plurality of display cells has in its area a pair of first and second display discharge electrodes each coupled to different and adjacent bus electrodes; and a plurality of data electrodes provided on said second substrate and extending in said column direction;

wherein display information is written in selected display cells by applying a data pulse to selected ones of said plurality of data electrodes that correspond to said selected display cells in synchronism with scanning pulses applied to said plurality of bus electrodes in a scanning period and the discharge at said selected display cells is sustained by applying sustaining pulses to said plurality of bus electrodes in a sustaining period in a manner that a phase of said sustaining pulses applied to one of said plurality of bus electrodes is opposite to the phase of said sustaining pulses applied to adjacent one of said plurality of bus electrodes.

28. The plasma display panel of claim 27, wherein a discharge starting voltage between said first display discharge electrodes and one of said plurality of data electrodes is substantially equal to a discharge starting voltage between said second display discharge electrodes and said one of said plurality of data electrodes, and wherein when a scanning pulse is applied to one of said plurality of bus electrodes, first and second voltages different from each other and different from the voltage of said scanning pulse are applied to two other of said plurality of bus electrodes adjacent to said one of said plurality of bus electrodes.

29. The plasma display panel of claim 28, wherein said first display discharge electrodes has a substantially similar shape to said second display discharge electrode.

30. The plasma display panel of claim 27, wherein a discharge starting voltage between said first display discharge electrodes and one of said plurality of data electrodes has a higher amplitude than a discharge starting voltage between said second display discharge electrodes and said one of said plurality of data electrodes.

31. A plasma display panel, comprising:

first and second substrates disposed oppositely to each other;

a parallel-crossed partition wall defining a space between said first and second substrates into a plurality of display cells arrayed in row and column directions;

a plurality of bus electrodes on said first substrate and superposed on a portion of said partition wall that extends in said row direction;

a plurality of pairs of first and second display discharge electrodes coupled to each of said plurality of bus electrodes such that the first display discharge electrode extends from one of said plurality of bus electrodes into an area of one of said plurality of display cells adjacent to said one of said plurality of bus electrodes in said column direction and the second display discharge electrode extends from said one of said plurality of bus electrodes in an opposite direction from said first display discharge electrode in said column direction into an area of another one of said plurality of display cells adjacent to said one of said plurality of bus electrodes and adjacent to said one of said plurality of display cells in said column direction, wherein each of said plurality of display cells has in its area a pair of first and second display discharge electrodes each coupled to different and adjacent bus electrodes;

a plurality of data electrodes provided on said second substrate and extending in said column direction; and a driving circuit that writes display information in selected display cells by applying a data pulse to selected ones of said plurality of data electrodes that correspond to said selected display cells, applies scanning pulses to said plurality of bus electrodes in synchronism with said data pulses in a scanning period, applies sustaining pulses to a group of said plurality of bus electrodes in a first phase and applies sustaining pulses to another group of said plurality of bus electrodes in a second phase that is opposite to said first phase.

* * * * *